US007983728B2

(12) United States Patent
Shiokawa et al.

(10) Patent No.: US 7,983,728 B2
(45) Date of Patent: Jul. 19, 2011

(54) RESONATOR COMPRISED OF A BENT CONDUCTOR LINE WITH SLITS THEREIN AND A FILTER FORMED THEREFROM

(75) Inventors: Noritsugu Shiokawa, Yokohama (JP); Hiroyuki Kayano, Fujisawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 143 days.

(21) Appl. No.: 12/323,255

(22) Filed: Nov. 25, 2008

(65) Prior Publication Data

US 2009/0146762 A1 Jun. 11, 2009

(30) Foreign Application Priority Data

Nov. 26, 2007 (JP) ..... P2007-304571

(51) Int. Cl.
*H01P 7/08* (2006.01)
*H01P 1/203* (2006.01)
*H01B 12/02* (2006.01)

(52) U.S. Cl. ..... 505/210; 333/204; 333/219; 333/99 S

(58) Field of Classification Search ..... 333/204, 333/219, 99 S; 505/210
See application file for complete search history.

(56) References Cited

U.S. PATENT DOCUMENTS

| | | | | |
|---|---|---|---|---|
| 5,888,942 | A | 3/1999 | Matthaei | |
| 5,922,650 | A | 7/1999 | Ye | |
| 6,144,268 | A * | 11/2000 | Matsui et al. | 333/134 |
| 6,438,395 | B1 * | 8/2002 | Hidaka et al. | 505/210 |

FOREIGN PATENT DOCUMENTS

| | | |
|---|---|---|
| EP | 0 741 432 A2 | 11/1996 |
| EP | 0 917 236 A2 | 5/1999 |
| JP | 7-94914 | 4/1995 |
| JP | 08-321706 | 12/1996 |
| JP | 11-177310 | 7/1999 |
| JP | 2008-35088 | 2/2008 |

OTHER PUBLICATIONS

Notification of Reason for Refusal issued by the Japanese Patent Office on Dec. 8, 2009, for Japanese Patent Application No. 2007-304571, and English-language translation.
European Search Report issued by the European Patent Office on Apr. 1, 2009, for European Patent Application No. 08253812.5.

* cited by examiner

*Primary Examiner* — Benny T. Lee
(74) *Attorney, Agent, or Firm* — Finnegan, Henderson, Farabow, Garrett & Dunner, L.L.P.

(57) ABSTRACT

According to an aspect of the present invention, there is provided a resonator including: a transmission line including a conductor line with a bent portion, wherein the conductor line has a plurality of slits formed therein, the slits being formed in an extending direction of the conductor line to pass through the bent portion, and wherein the slits are formed to have intervals that become narrower from an outer-side toward an inner-side of the bent portion.

8 Claims, 29 Drawing Sheets

RESONATOR COMPRISED OF A BENT CONDUCTOR LINE WITH SLITS THEREIN AND A FILTER FORMED THEREFROM

CROSS-REFERENCE TO RELATED APPLICATIONS

This application claims priority from Japanese Patent Application No. 2007-304571 filed on Nov. 26, 2007, the entire contents of which are incorporated herein by reference.

BACKGROUND OF THE INVENTION

1. Field of the Invention

An aspect of the present invention relates to a resonator and a filter used in a microwave device, such as a broadcasting device, a communications device, a measuring device.

2. Description of the Related Art

As the simplest resonator structure using a strip line or a microstrip line, there is known a structure consisting of: a conductor line having a half wavelength (or a multiple thereof) at a resonance frequency; a dielectric substrate; and a ground plane. When the resonator resonates with a mode in which a current flow along the conductor line, a current density in the resonant state is most concentrated at an edge of the conductor line, and the concentration tendency becomes more noticeable with an increase in frequency.

When the above-mentioned structure is adapted to a microwave resonator for a high-power signal, such as a signal having a power of 1 W or more, a current concentration on the edge poses a problem. Because, a particularly-large current density is induced at an edge of the conductor line by the high power signal, and a conductor loss arising in the edge consequently becomes a dominant cause for a loss in the resonator. Further, when a current density exceeds an allowable level for the conductor material, the conductive property of the conductor material may be destroyed. For example, when a superconducting material is used for the conductor line, an excess current density at the edge may destroy the conductive property of the conductor line.

A method for relaxing the current concentration at the edge of the straight-type conductor line by forming a plurality of slits at uniform intervals therealong is proposed, in JP-H08-321706-A. A method which is an improvement upon the method proposed in JP-H08-321706-A and which is proposed in JP-H11-177310-A is a method for forming a single slit or a plurality of slits, along a straight-shaped conductor line, in only an edge thereof.

The simplest shape of the conductor line is a straight line shape. In addition, to be mounted in a limited space, the conductor line may be formed to have a bent portion. For example, a hairpin shape, a spiral shape, a meandering shape, an L shape, an M shape, and an S shape have been proposed.

When a transmission line, such as a strip line or a microstrip line, formed in a straight shape is used as a resonator, the method of JP-H08-321706-A or JP-H11-177310-A may be effective. However, when a bent shape is applied to a conductor line, a current concentration arises at an inner-side edge of the bent portion.

SUMMARY OF THE INVENTION

One of the objects of the present invention is to provide a resonator and a filter in which a current distribution at the bent portion of the conductor line is uniformed to have a low loss property and a high-power handling.

According to an aspect of the present invention, there is provided a resonator including: a transmission line including a conductor line with a bent portion, wherein the conductor line has a plurality of slits formed therein, the slits being formed in an extending direction of the conductor line to pass through the bent portion, and wherein the slits are formed to have intervals that become narrower from an outer-side toward an inner-side of the bent portion.

The slits may not be provided in both ends of the conductor line.

The slits may be formed to have an electrical length of 45 degrees to 90 degrees at a resonance frequency of the resonator, and the slits may be formed so that a lengthwise center of the slits are positioned at the substantially same position with a lengthwise center of the bent portion.

The conductor line may have an angular-U shape.

The conductor line may have a circular-U shape.

The conductor line may be formed of a superconducting material.

The transmission line may include: a strip line; or a microstrip line.

According to another aspect of the present invention, there is provided a filter including the above-described resonator.

DETAILED DESCRIPTION OF THE INVENTION

Figure 29:
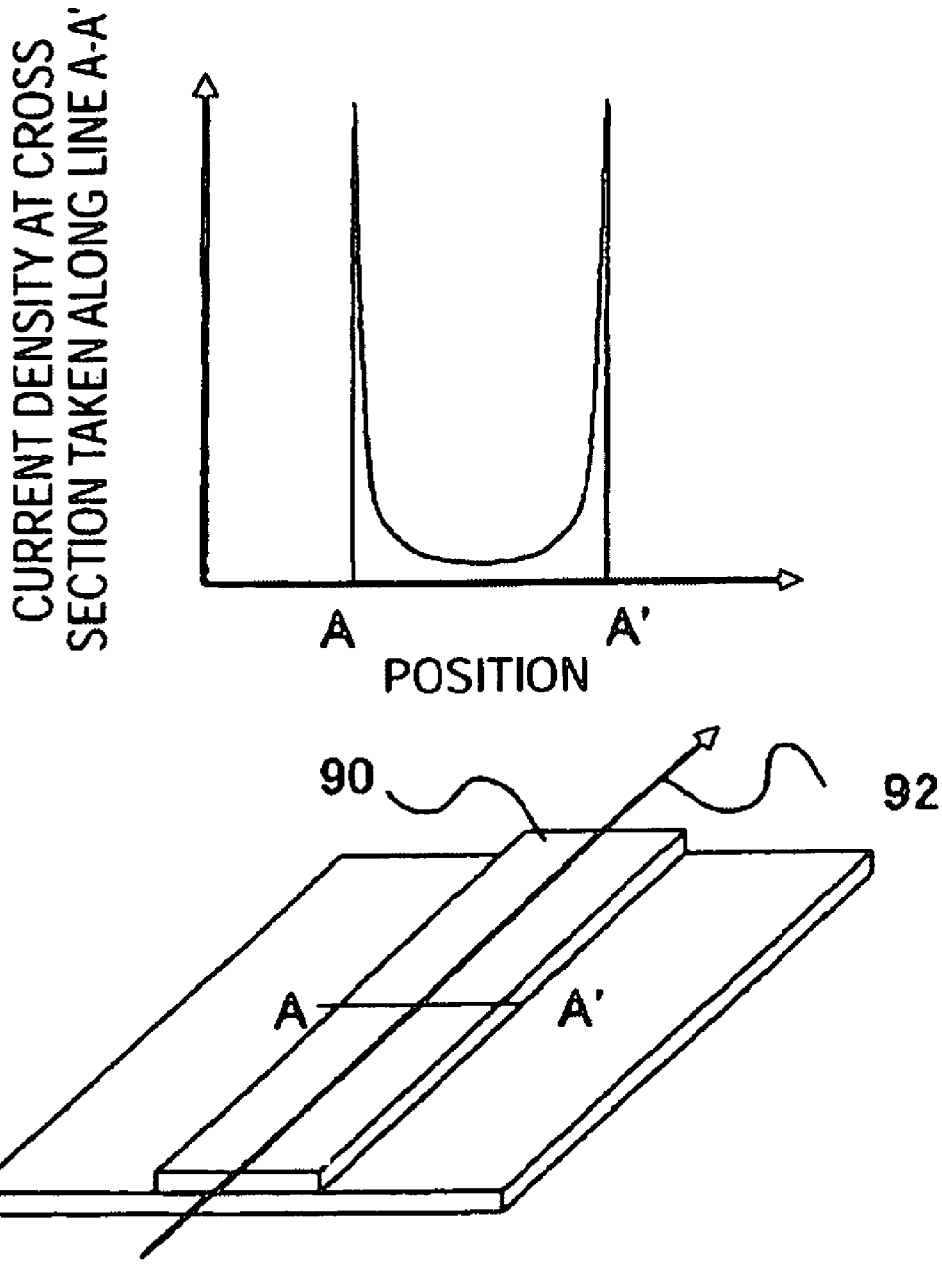
FIG. 29 Prior Art
FIG. 29 is a descriptive view of a current concentration in a straight-shaped conductor line.

As mentioned above, when a conductor line has a bent portion, a problem of current concentration on an inner-side edge of the bent portion of the conductor line arises. FIG. 29 is a descriptive view of current concentration along a position of line A-A' in the straight-shaped conductor line. As illustrated, a current concentrates on an edge in a straight-shaped conductor line 90 and distributes symmetrical with respect to a center axis 92 of the conductor line 90.

Figure 30:
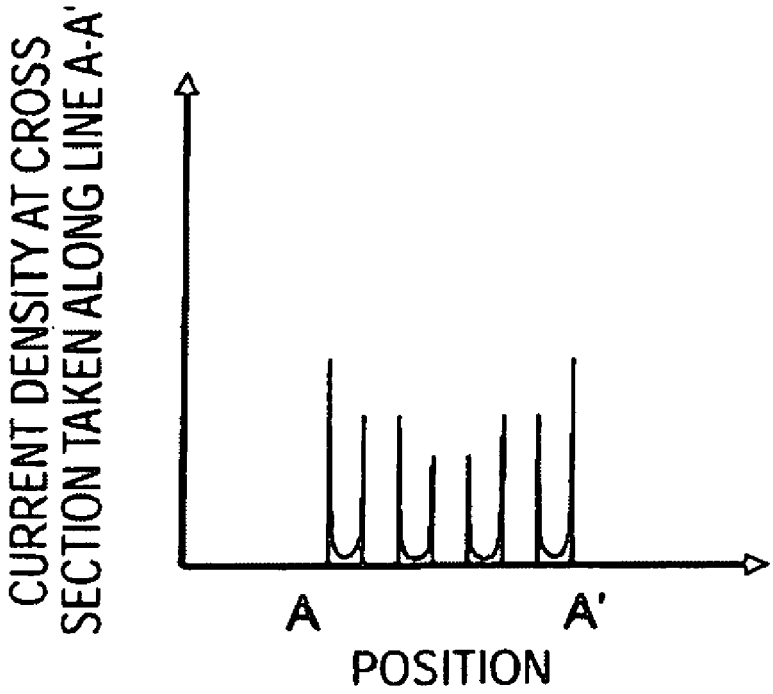
FIG. 30 Prior Art
FIG. 30 is a descriptive view of a current concentration in the straight-shaped conductor line with slits.
Figure 30:
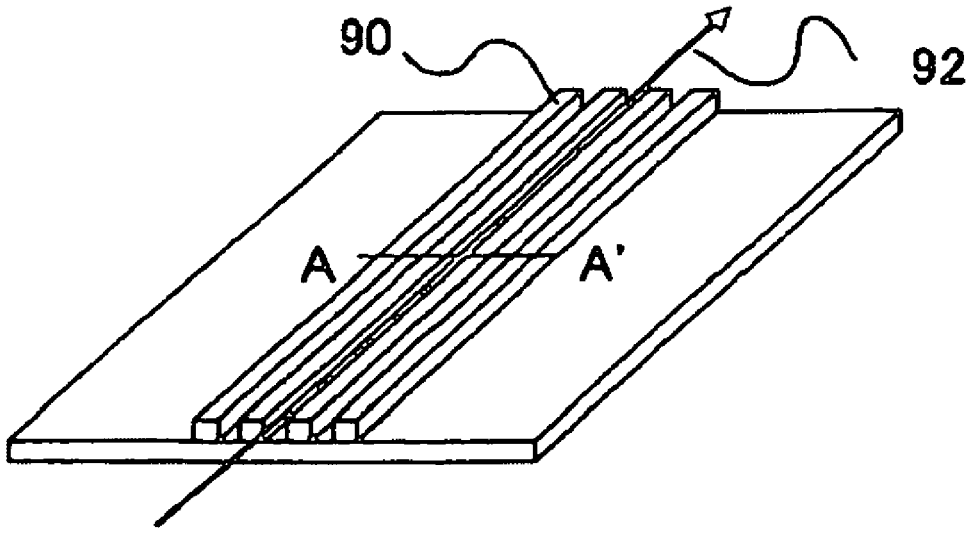
FIG. 30 Prior Art

FIG. 30 is a descriptive view of current concentration along a position of line A-A' in the straight-shaped conductor line provided with slits. The slits are provided in the conductor line 90 to be symmetrical with respect to the center axis 92, whereby a current density distribution is uniformed.

Figure 31:
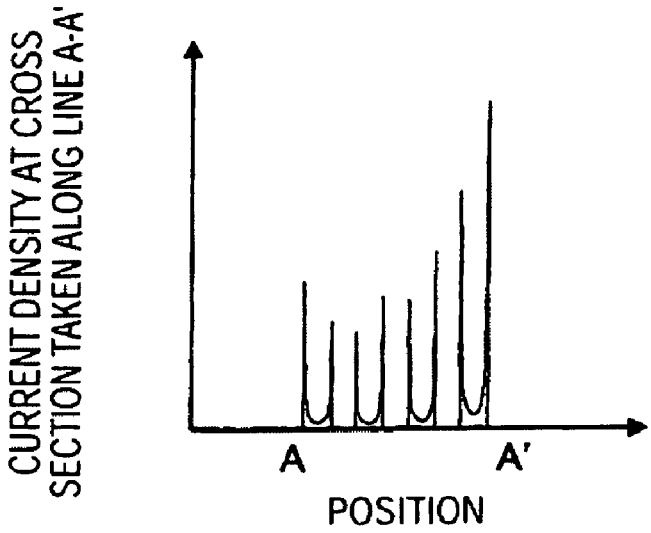
FIG.31 Prior Art
FIG. 31 is a descriptive view of a current concentration in a conductor line having a bent portion with slits.
Figure 31:
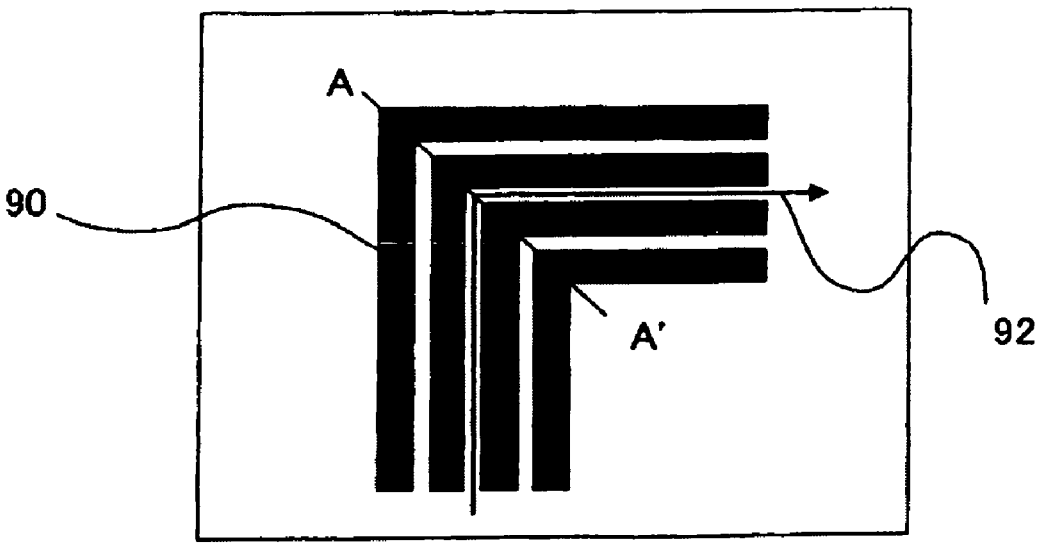
FIG.31 Prior Art

FIG. 31 is a descriptive view of current concentration along a position of line A-A' in a conductor line having a bent portion in which a slit is formed. As illustrated, when the conductor line 90 has a bent portion, a current distribution becomes uneven from the outer-side to inner-side of the bent portion. That is, even if the slit symmetrically with respect to the center axis 92 is provided, the current concentration on inner-side edges of the bent portion of the conductor line, which is represented by the rightmost peak in a graph of FIG. 31, can not be resolved. The large current density in the edges limits a loss property and a power handling.

Embodiments of the present invention, in which the current concentration on the inner-side edges of a bent portion of a conductor line is relaxed, will be described hereunder by reference to the drawings.

First Embodiment

A resonator according to a first embodiment of the present invention consists of a transmission line with a conductor line having a bent portion. A microstrip line, in which a plurality of slits are formed in the conductor line along the extending direction thereof, and in which intervals of the slits become narrower toward the inner-side of the bent portion, is used as the transmission line.

As mentioned above, the slits, which are narrower toward the inner-side of the bent portion, are provided in the transmission line, so that a current concentration on inner-side edges of the bent portion can be prevented and a high power handling and a low power loss of the resonator can be attained.

Figure 1:
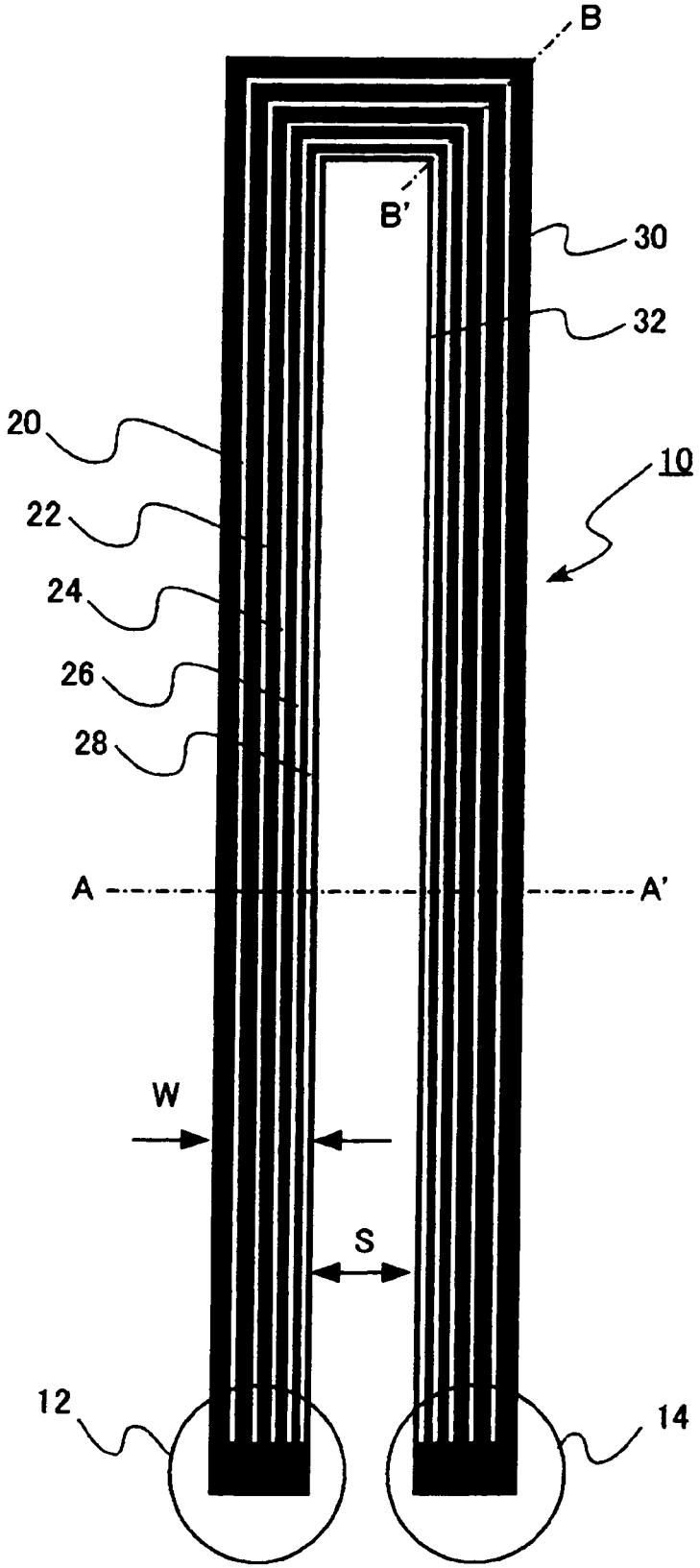
FIG. 1 is a plan view showing a conductor line pattern of a resonator according to a first embodiment.

FIG. 1 is a plan view showing a conductor line pattern of the resonator of the present embodiment. In the present embodiment, a microstrip line is used as the transmission line constituting the resonator. The drawing shows a top view of a substrate of a microstrip line, as viewed from above, wherein black-painted areas constitute the conductor line 10. The conductor line 10 has an angular-U hairpin shape. Five slits 20, 22, 24, 26, and 28 are provided in the bent portion of the hairpin resonator so as to extend from the neighborhood of one end 12 to the neighborhood of another end 14 along the direction of extension of the conductor line 10. The slit 20 is the outermost slit in the bent portion, and the slit 28 is the innermost slit of the bent portion.

An interval between adjacent slits of the five slits; namely, the widths of lines sandwiched among the slits, become smaller toward the inner-side from the outer-side of the bent portion. In the present embodiment, the intervals have a ratio of 3.4:2.8, a ratio of 2.8:2.2, and a ratio of 2.2:1.6 from the outer-side. Among the lines separated by the slits, a ratio of the width of the outermost line 30 to the width of the innermost line 32 is a ratio of 4:1.

In the present embodiment, both ends 12 and 14 of the conductor line 10 are closed, namely, no slits are provided at both ends of the conductor line 10.

Figure 2:
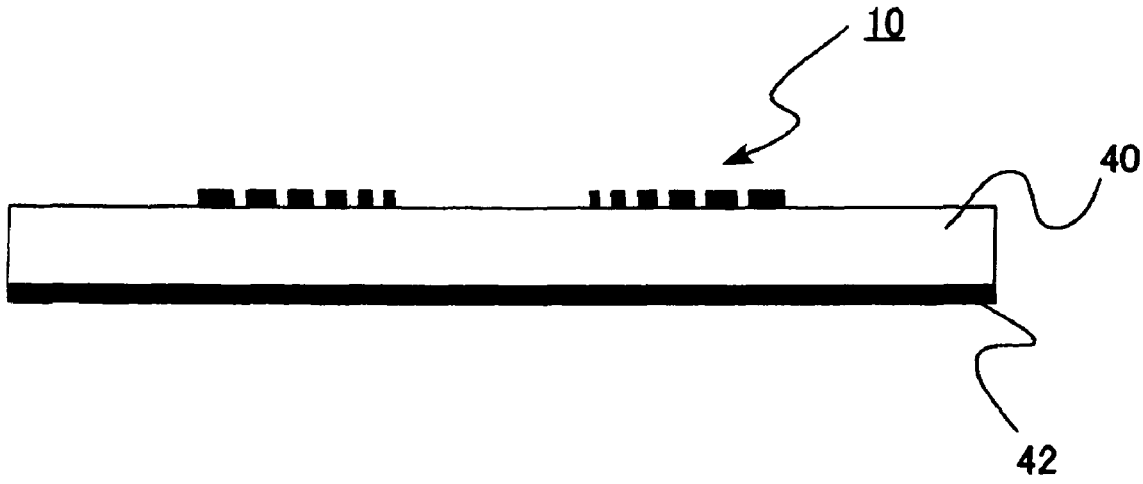
FIG. 2 is a cross-sectional view of the resonator shown in FIG. 1 taken along line A-A'.

FIG. 2 is a cross-sectional view of the resonator shown in FIG. 1 taken along line A-A'. The conductor line 10 shown in FIG. 1 is laid on an upper surface of a dielectric substrate 40. A ground plate 42 is formed of a conductive material on a lower surface of the dielectric substrate 40, thereby forming a microstrip line. The conductor line 10 is formed of, for instance, YBCO that is a superconducting material. For instance, sapphire is used for the dielectric substrate 40.

Figure 3:
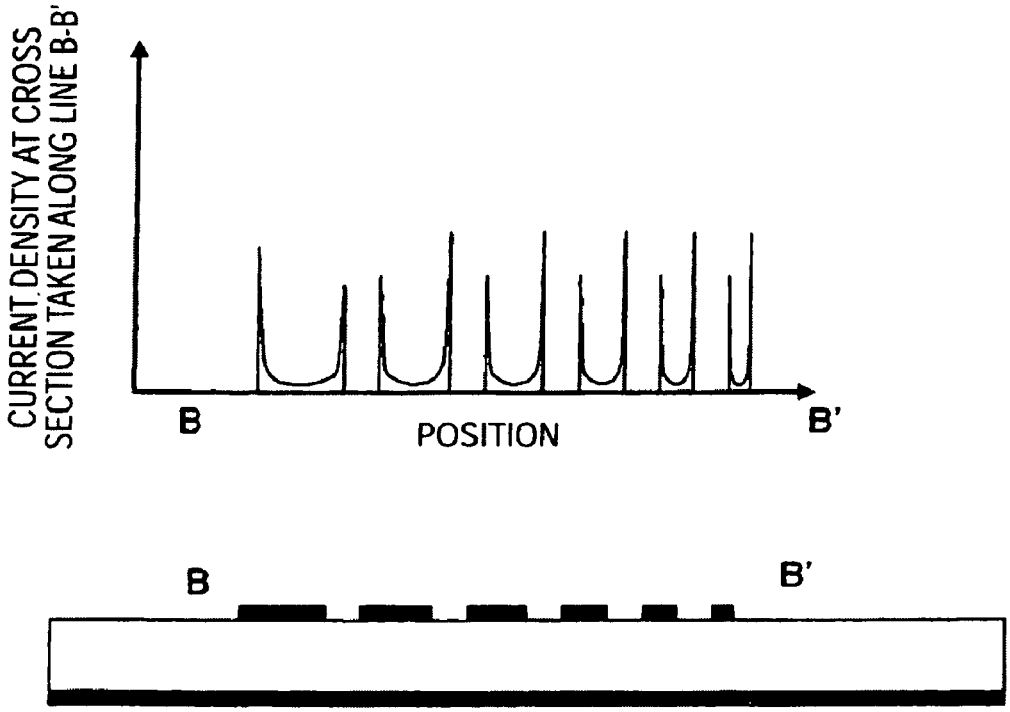
FIG. 3 is a view showing the distribution of a current density achieved in a cross section of the resonator shown in FIG. 1 taken along line B-B'.

FIG. 3 is a cross-sectional view of the resonator shown in FIG. 1 taken along line B-B' and a view showing the distribution of a current density achieved in the cross section of the resonator. A graph provided in an upper portion of FIG. 3 shows the distribution of a current density, wherein a vertical axis represents a current density and a horizontal axis represents a position. When compared with FIG. 31, the current density on the inner-side of the bent portion (the B' side) is understood to be made uniform so as to become essentially identical with that on the outer-side of the bent portion. A simulation result acquired by an electromagnetic simulator show that a maximum current density of a hairpin resonator whose slits become narrower toward the inner-side of a bent portion comes to about one-third the maximum current density of a resonator having uniformly-spaced five slits.

In the simulation, a resonance frequency is 800 MHz; the line width (W in FIG. 1) is 2 mm; a line interval (S in FIG. 1) is 2 mm; the slit width is 0.1 mm; and ratios of the slit intervals are the same as those achieved in FIG. 1.

As mentioned above, as compared with a related-art resonator, in the embodiment resonator, the current concentration on a bent portion is significantly reduced. Therefore, a resonator exhibiting high power handling can be realized. Since a conductor loss in the bent portion is also diminished, a low-loss resonator can be implemented.

Figure 4:
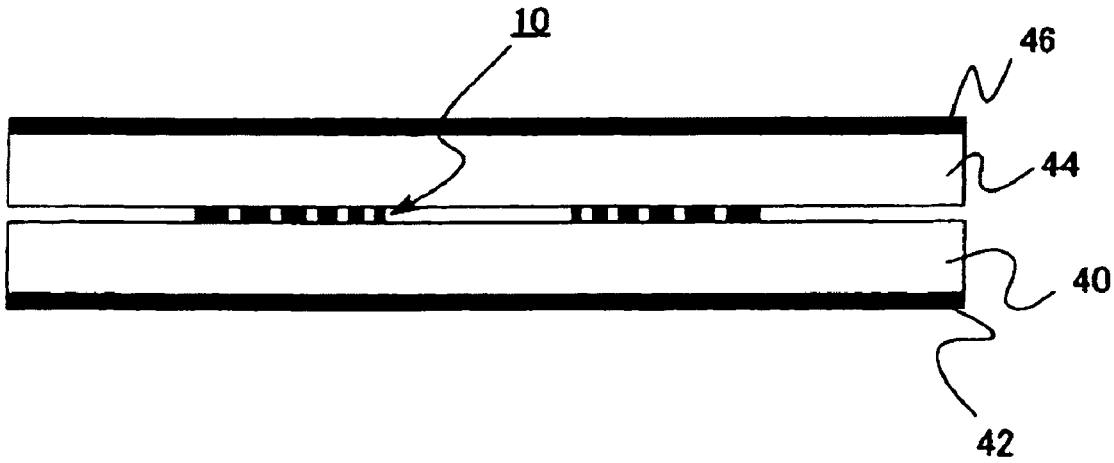
FIG. 4 is a cross-sectional view of the resonator having a strip line structure of a modification according to the first embodiment.

Although the microstrip line is used as the transmission line in the present embodiment, for example, a strip line may be used. FIG. 4 is a cross-sectional view of a resonator having a strip line structure that is a modification of the present embodiment. In contrast with the microstrip line shown in FIG. 2, the strip line shown in FIG. 4 includes a second dielectric substrate 44 laid on the conductor line 10 and a second ground plane 46 formed on the second dielectric substrate 44, in addition to the dielectric substrate 40 and the ground 42.

Figure 5:
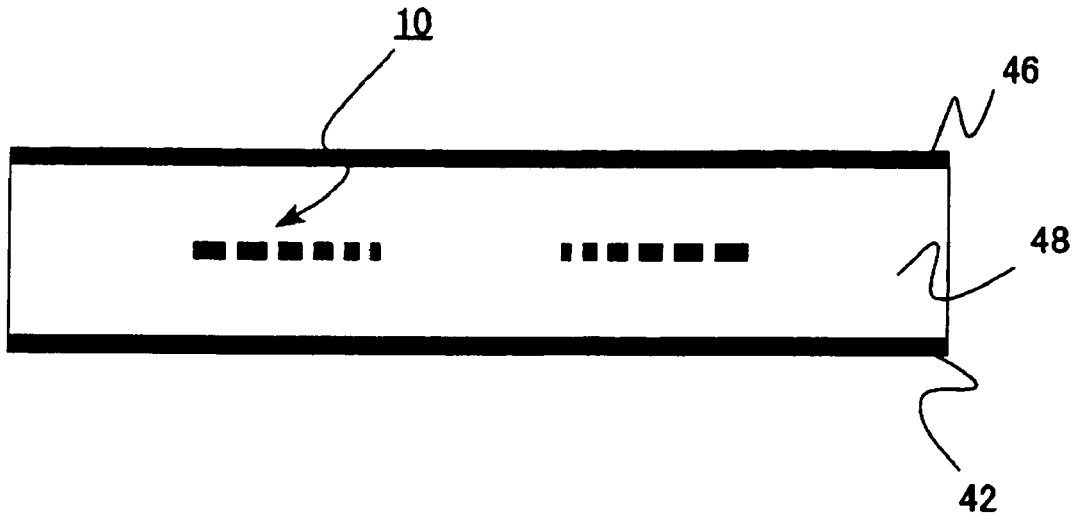
FIG. 5 is a cross-sectional view of the resonator having a strip line structure of the modification according to the first embodiment.
Figure 6:
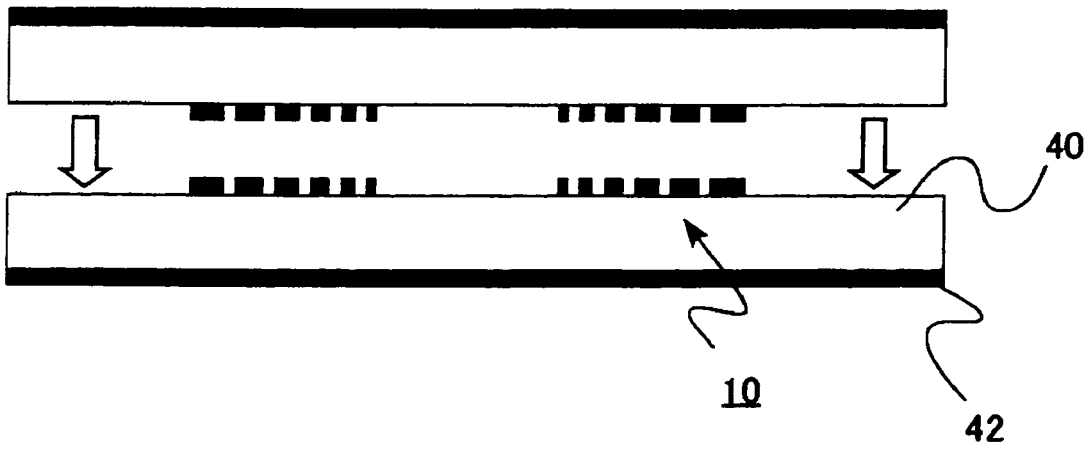
FIG. 6 is a cross-sectional view showing a method for manufacturing a strip line structure of the modification according to the first embodiment.

FIG. 5 is a cross-sectional view of a resonator having another-type strip line. In this strip line, the conductor line 10 is embedded in a dielectric 48, and the ground planes 42 and 46 are formed on the upper and lower surfaces of the dielectric 48. FIG. 6 is a cross-sectional view showing a method for manufacturing the another-type strip line structure. Two microstrip lines, each of which includes the conductor line 10, the dielectric substrate 40, and the ground plane 42 as shown in FIG. 2, are affixed together, thereby constituting a strip line. Such a strip line can also be used as the transmission line.

Figure 7:
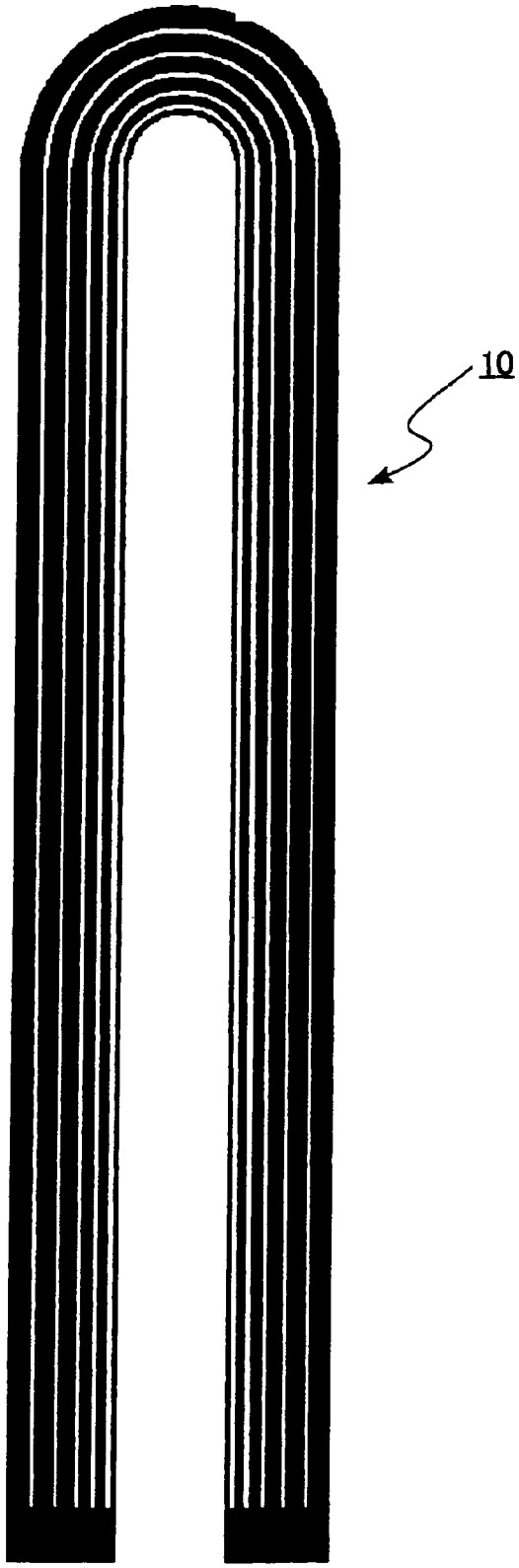
FIG. 7 is a plan view showing a conductor line pattern of a resonator of a modification according to the first embodiment.

In the present embodiment, the conductor line is shaped in a U shape. Generally, in a microstrip line using a straight-shaped conductor line, a radiation loss increases with an increase in frequency. For this reason, it is preferable to providing a bent portion in the conductor line to suppress radiation. However, as the number of bent portions increases, the number of locations where a current is concentrated increases, and hence a conductor loss also increases. Therefore, in the light of achievement of a balance between a radiation loss and a conductor loss, it is desirable that the conductor line assume a U shape having one bent portion from a macroscopic viewpoint and two bent portions from a microscopic viewpoint. When a strip-line-type transmission line is used in a condition where a radiation loss is sufficiently low, or when a microstrip-line-type transmission line is used in a condition where a low frequency is achieved, a bent portion is formed in a conductor line in order to mount a resonator in a limited size. Even in such a case, it is desirable to reduce the number of bent portions for minimizing a conductor loss. FIG. 7 is a plan view showing a conductor line pattern of a resonator that is a modification according to the first embodiment. The conductor line has the U shape. Specifically, as compared with the angular-U shape shown in FIG. 1, the bent portion of the conductor line 10 has a circular-U shape. In contrast with the angular shape, a circular shape of the bent portion enables lessening of the current concentration on the bent portion.

Of course, the effect of lessening the current concentration on the bent portion yielded by the present invention can also be yielded by varieties of resonators, so long as a conductor line is provided with a bent portion. Although angular-U and circular-U hairpin shapes are shown, various shapes having a single or a plurality of kinked or bent portions, such as a spiral shape, a meandering shape, an L shape, an M shape, an S shape, and an oval shape may be applied.

The number of slits is also not limited to five, and an arbitrary number of slits is acceptable. However, as the number of slits increases, the number of boundary planes between a conductor section and an insulation section (an area which is not a conductor) also increases. Hence, when a design is conceived by use of, for instance, an electromagnetic simulator, computation involves consumption of much time. Therefore, the practical maximum number of slits is about 100, and, more preferably, ten slits or less are effective.

In the present embodiment, both ends 12 and 14 of the conductor line 10 are closed. Specifically, no slits are formed at both ends 12 and 14 of the conductor line 10 shown in FIG. 1. If slits are formed up to the both ends, respective split conductor lines may function as a plurality of resonators, to thus cause an unwanted resonance mode. To suppress the unwanted resonance mode, the both ends are closed in the present embodiment.

The embodiment has been described thus far by taking, as an example, the case where the conductor line is formed of a superconducting material. In a case where a conductor line is formed of a superconducting material, when a critical current density of the superconducting material is exceeded as a result of a current concentration on a bent portion, the resistance of the conductor line abruptly increases, and a desired characteristic for the resonator can not attained. Therefore, when the transmission line is formed of a superconducting material, the present embodiment is effective. Of cause, the material of the conductor line is not limited to the superconducting material, and an arbitrary conductive material can also be applied to the conductor line.

Second Embodiment

A resonator according to a second embodiment of the present invention is analogous to the resonator according to the first embodiment except the following features, and hence its explanations are omitted. The slit length ranges from 45 degrees to 90 degrees of an electrical length at a resonance frequency of the resonator. Essentially-center portions of the slits achieved in the lengthwise direction thereof are located in the center of the bent portion.

An unwanted resonance mode can be avoided by reducing the slit length, while attaining the high power handling and the low conductor loss by relaxing a current concentration on a bent portion.

Figure 8:
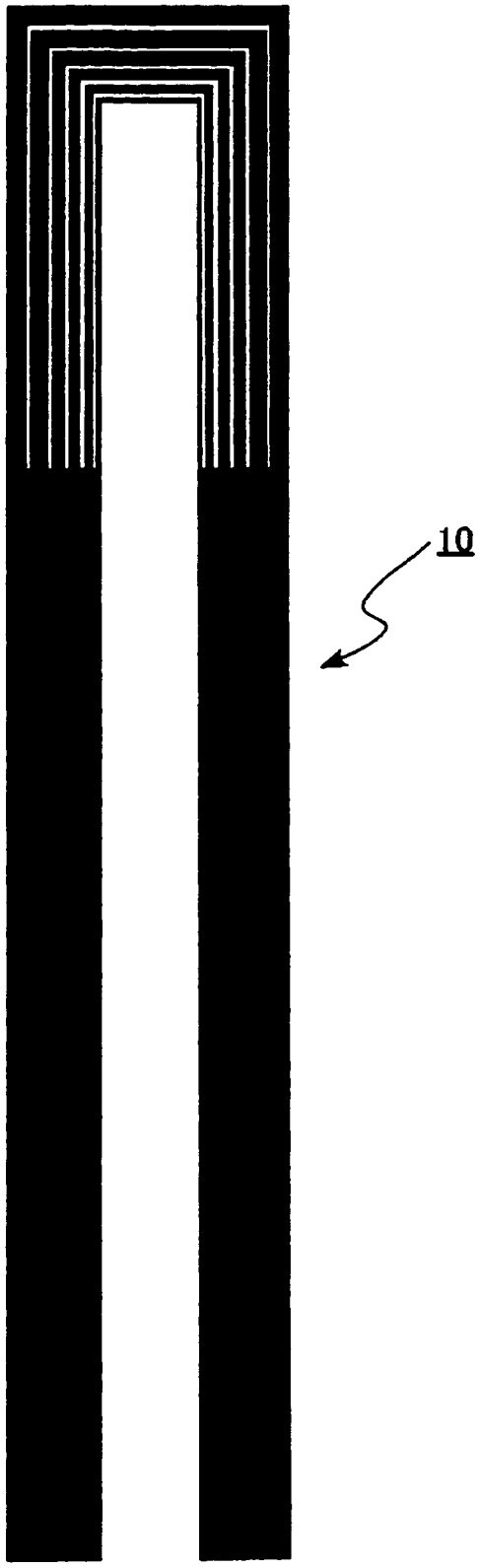
FIG. 8 is a plan view showing a conductor line pattern of a resonator according to a second embodiment.

FIG. 8 is a plan view showing a conductor line pattern of the resonator of the present embodiment. As in the first embodiment, a microstrip line is used. The drawing is a view of a substrate of a microstrip line acquired when viewed from the direction of an upper surface thereof, and black-painted areas constitute the conductor line 10.

As illustrated, as distinct from the first embodiment, the slits are limited solely to a neighborhood of the bent portion of the conductor line, for instance, a range of ±30 degrees (a total of 60 degrees) of an electrical length at the resonance frequency of the resonator. Further, the essentially-center portions of the slits achieved in the lengthwise direction thereof are placed in essentially the center of the bent portion. The reason why the center of the slits is described as the essentially-center portions is because, even when the center of the slits is not placed strictly in the center of the bent portion due to a machining error in regard to a design, or the like, the center can be deemed as being located substantially in the center and because working-effects similar to those yielded when the center of the slits are strictly located in the center of the bent portion can be yielded.

Figure 9C:
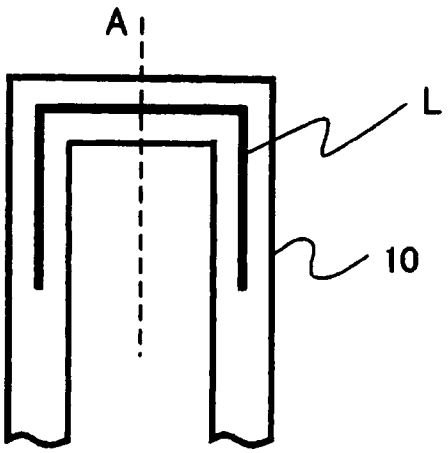
FIGS. 9A to 9C are views for describing the definition of a center of a bent portion according to the second embodiment.
Figure 9B:
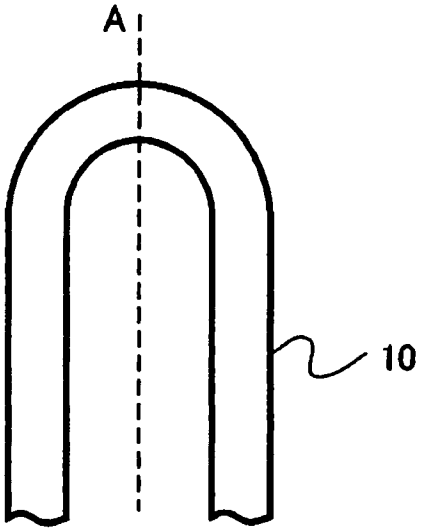
Figure 9A:
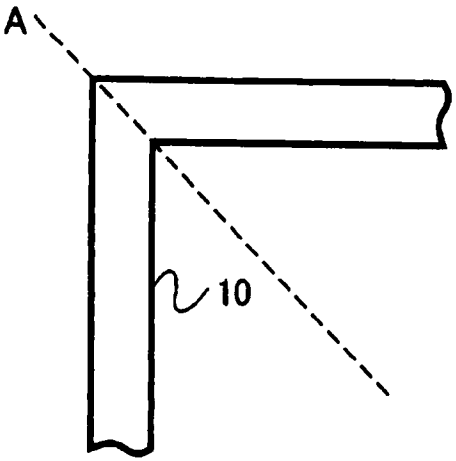

FIGS. 9A to 9C are views for describing the definition of the center of the bent portion. The word "center of the bent portion" means an area where an axis of symmetry A runs across the conductor line 10 when the conductor line 10 including the bent portion is essentially symmetrical as in the cases shown in FIGS. 9A and 9B. However, it may also be the case where slits of a desired electrical length cannot be designed because a plurality of slits overlap each other when the center of the bent portion determined by the above definition is used, as in the case where bent portions are continual. Accordingly, in such a case, a virtual line segment L, which has a desired electrical length and which runs the center and bent portion of a conductor line, is assumed as shown in FIG. 9C. When the line segment L is arranged at a position where the line segment exhibits line symmetry, an area where the axis of symmetry A of the line segment runs across the conductor line 10 is defined as the center of the bent portion.

The reason why the electrical length at the resonance frequency of the resonator is limited to a range from 45 degrees to 90 degrees will be described below.

As compared to a slitless resonator, a resonator with slits induces occurrence of an unwanted resonance mode. In order to suppress the unwanted resonance mode, the electrical length of the slit is preferably 90 degrees or less. The word "suppressing" means that an unwanted resonance mode is sufficiently moved away from a resonance mode used for constituting a filter to such an extent that a resonance frequency of an unwanted resonance mode is sufficiently separated from a resonance frequency of a target resonance mode.

Specifically, an explanation is provided by taking, as an example, an 800-MHz-band resonator and a 5-GHz-band resonator. In a case where a resonance frequency is 800 MHz, the resonator used for computation to be described below has the following sizes. Namely, the line width (W in FIG. 1) is 2 mm; a line interval (S in FIG. 1) is 2 mm; the slit width is 0.1 mm; and ratios of the slit intervals are the same as those shown in FIG. 1. In a case where a resonance frequency is 5 GHz, the resonator used for computation to be described below has the following sizes. Namely, the line width (W in FIG. 1) is 0.32 mm; a line interval (S in FIG. 1) is 0.32 mm; the slit width is 0.016 mm; and ratios of the slit intervals are the same as those shown in FIG. 1.

Figure 10:
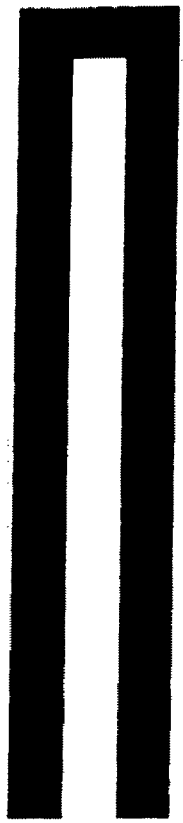
FIG. 10 Prior Art
FIG. 10 is a view showing a conductor line pattern of a slitless 800-MHz-band resonator for describing the second embodiment and a resonance characteristic of such a resonator.
Figure 10:
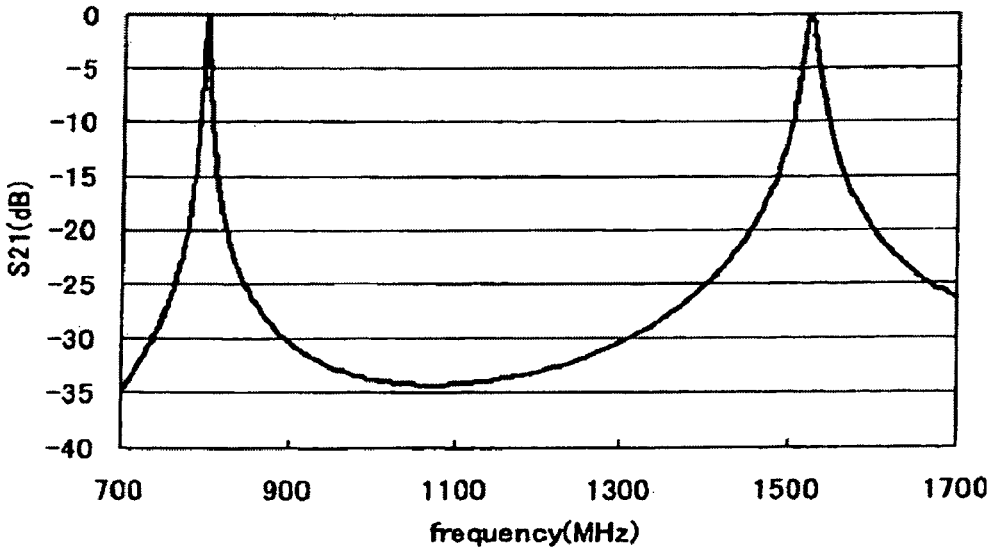
FIG. 10 Prior Art

FIG. 10 shows an example 800-MHz-band hairpin-type resonator that has no slits, and a U shape. An upper figure shows a conductor line pattern of the resonator, and a lower figure shows a resonance characteristic. In relation to the resonance characteristic, the horizontal axis represents a frequency in MHz, and the vertical axis represents a throughput (S21) in dB acquired when the resonator is excited as a result of an input-output line being made close to the resonator. Specifically, the drawing means that a resonance mode is present in frequencies at which peaks appear.

From the viewpoint of a resonance characteristic, a resonance peak is present in the vicinity of a frequency of 800 MHz and the vicinity of a frequency of 1500 MHz. A resonance peak appearing at 800 MHz is in a base resonance mode of half-wave resonance and used for a case where an 800-MHz-band filter is constituted by use of the resonator. A resonance peak appearing at 1500 MHz is a double wave of the frequency. The reason why the resonance peak is not accurately a double of the frequency is because an electrical length appears to differ between a case where adjacent currents are in phase with each other and a case where adjacent currents are out of phase with each other under influence of self-inductance. In the case of half-wave resonance, the adjacent currents are out of phase with each other. In the case of full-wavelength resonance of a double wave, the adjacent currents are in phase with each other. Therefore, in order to handle a resonator with slits in a manner similar to a slitless resonator slits up to at least a frequency range where a double wave appears, presence of no unwanted resonance mode in the frequency range is desirable.

Figure 11:
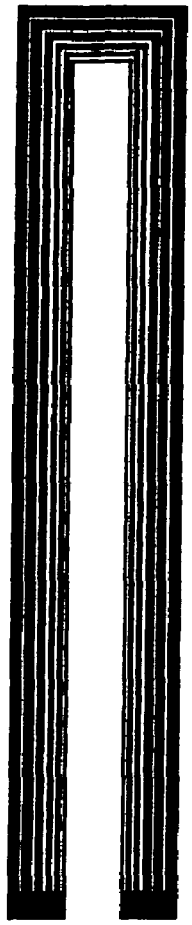
FIG. 11 is a view showing a conductor line pattern of an 800-MHz-band resonator having a slit length of 174 degrees for describing the second embodiment and a resonance characteristic of such a resonator.
Figure 11:
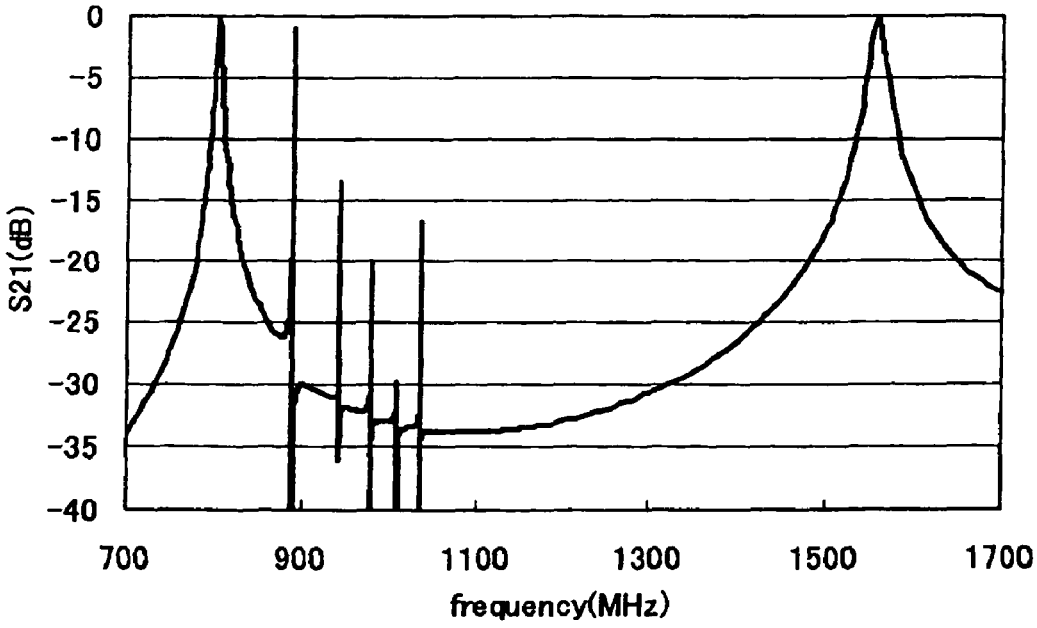
Figure 12:
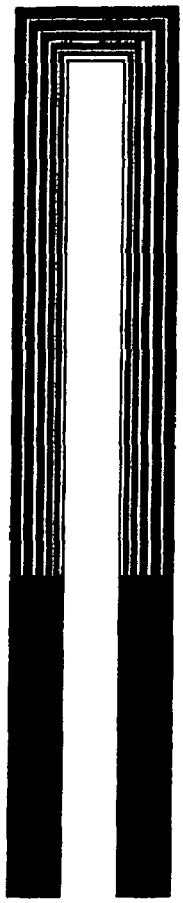
FIG. 12 is a view showing a conductor line pattern of an 800-MHz-band resonator having a slit length of 115 degrees for describing the second embodiment and a resonance characteristic of such a resonator.
Figure 12:
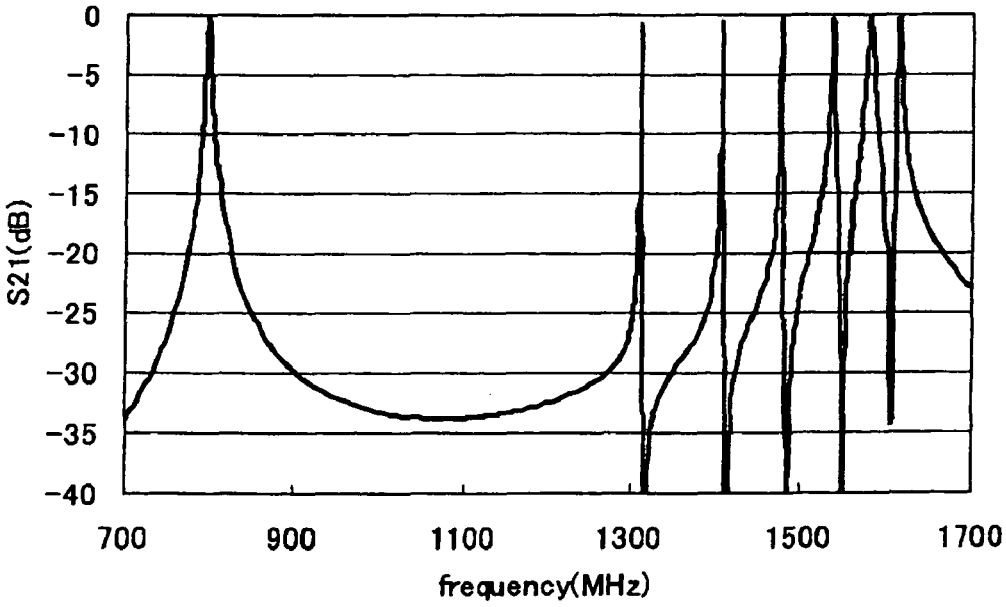
Figure 13:
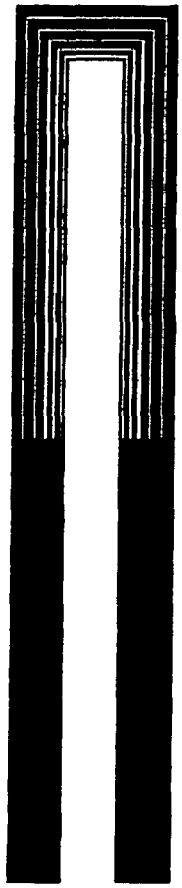
FIG. 13 is a view showing a conductor line pattern of an 800-MHz-band resonator having a slit length of 90 degrees for describing the second embodiment and a resonance characteristic of such a resonator.
Figure 13:
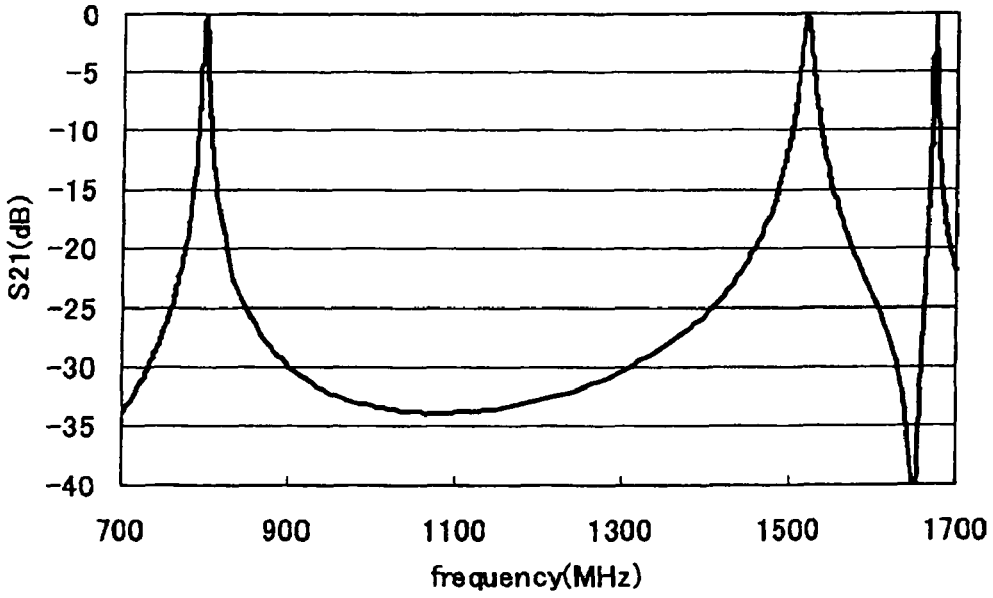
Figure 14:
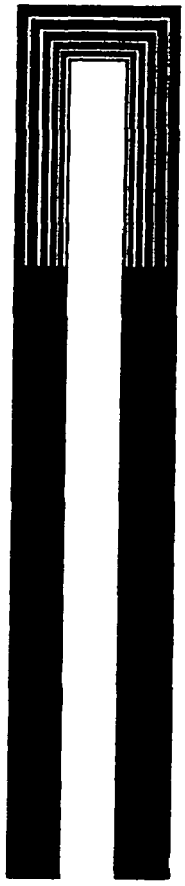
FIG. 14 is a view showing a conductor line pattern of an 800-MHz-band resonator having a slit length of 55 degrees for describing the second embodiment and a resonance characteristic of such a resonator.
Figure 14:
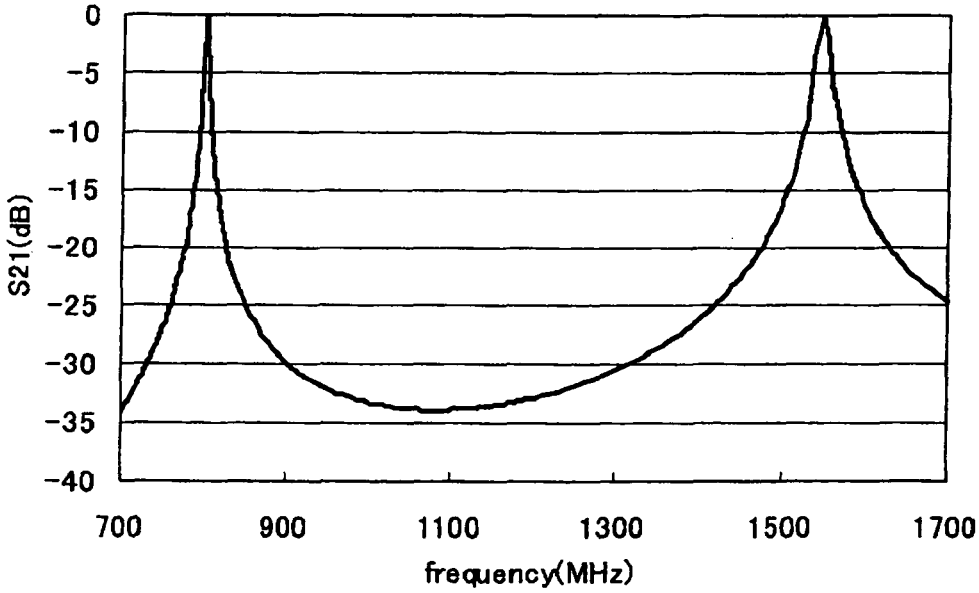
Figure 15:
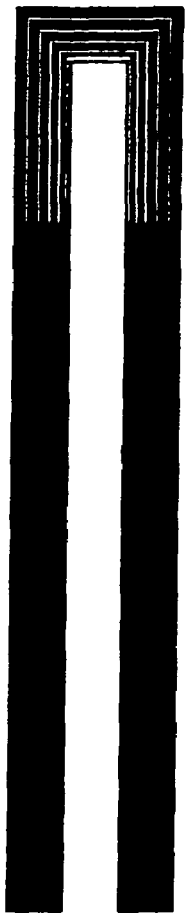
FIG. 15 is a view showing a conductor line pattern of an 800-MHz-band resonator having a slit length of 45 degrees for describing the second embodiment and a resonance characteristic of such a resonator.
Figure 15:
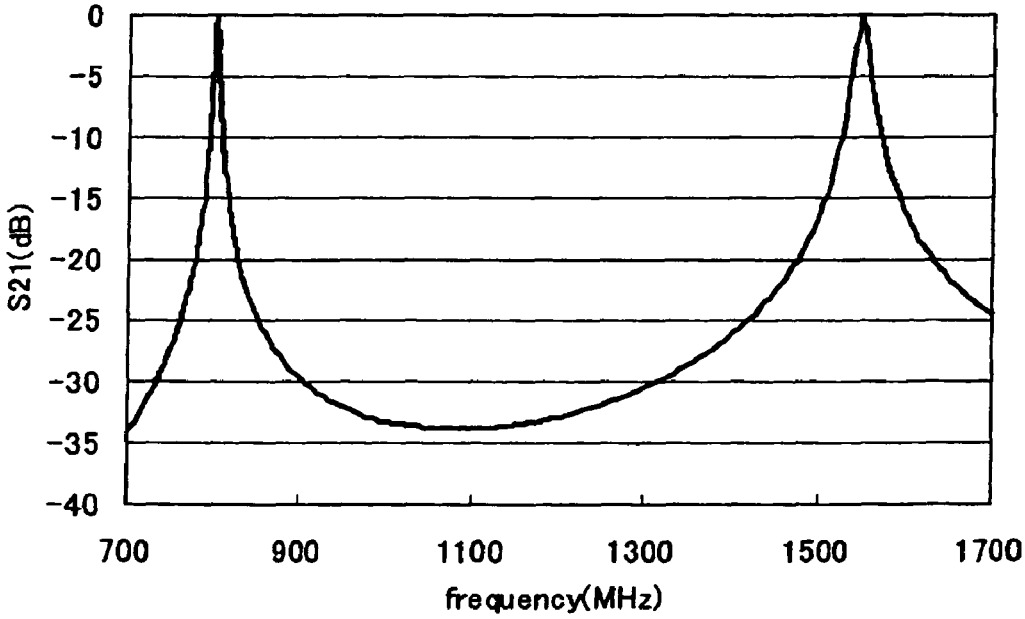
Figure 16:
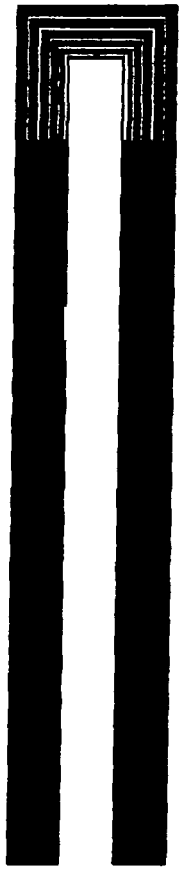
FIG. 16 is a view showing a conductor line pattern of an 800-MHz-band resonator having a slit length of 30 degrees for describing the second embodiment and a resonance characteristic of such a resonator.
Figure 16:
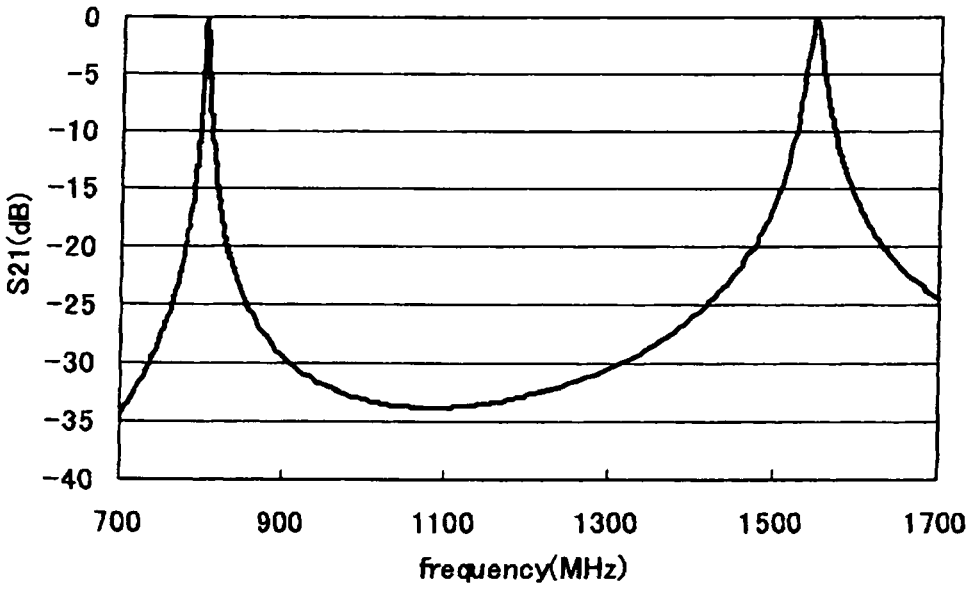

FIGS. 11 through 16 show a conductor line pattern and a resonance characteristic of an 800-MHz-band hairpin-type resonator acquired when the slit length is changed to 174 degrees, 115 degrees, 90 degrees, 55 degrees, 45 degrees, and 30 degrees of an electrical length, respectively. When the slit length is changed to 174 degrees and 115 degrees, as shown in FIGS. 11 and 12, respectively, resonance modes, which are not present in a slit-free resonator, are present in a range from 800 MHz to 1500 MHz. The resonance modes are those in which each of the slits acts as a resonator, and the slit length approximately corresponds to each resonance frequency. Therefore, if the slit length comes to 90 degrees or less of an electrical length, the resonance frequencies can be presumed to become higher than a frequency of 1500 MHz that is double-wave resonance (full-wave resonance). In fact, when the slit length is reduced to electrical lengths of 90 degrees, 55 degrees, 45 degrees, and 30 degrees, as shown in FIGS. 13-16, respectively, unwanted resonance modes are not present in the range from 800 MHz to 1500 MHz.

Figure 17:
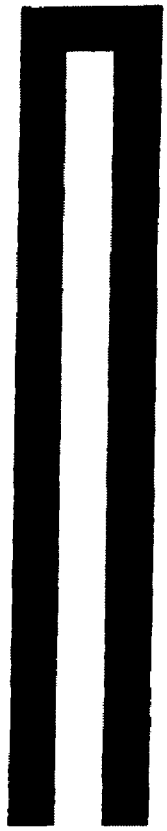
FIG. 17 Prior Art
FIG. 17 is a view showing a conductor line pattern of a slitless 5-GHz-band resonator for describing the second embodiment and a resonance characteristic of such a resonator.
Figure 17:
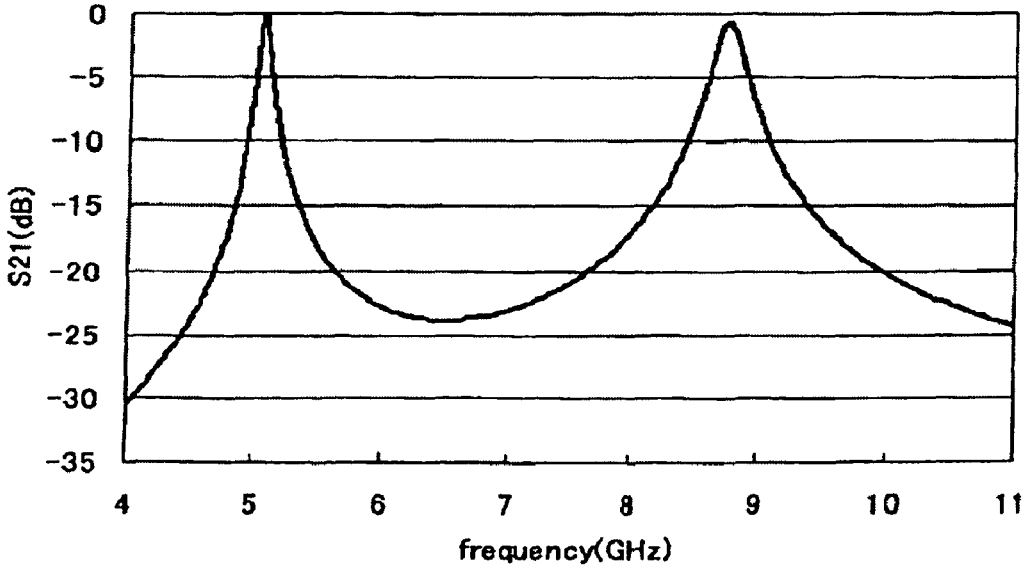
FIG. 17 Prior Art

The 800-MHz-band resonator is mentioned as an example in the above. However, in order to confirm whether or not the same results are obtained at another frequency band, the 5-GHz-band resonator was also subjected to the same operations. FIGS. 17 through 22 show results of the operations. A conductor line pattern of the resonator is provided in an upper portion of each of the drawings, and a resonance characteristic of the same is provided in a lower portion of each of the drawings. FIG. 17 shows a 5-GHz-band hairpin-type resonator that does not have any slits. Half-wave resonance appeared in the vicinity of 5 GHz, and full-wavelength resonance appeared in the vicinity of 8.8 GHz.

Figure 18:
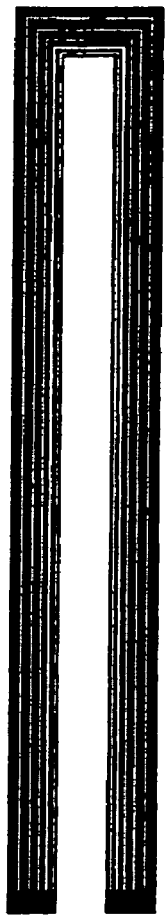
FIG. 18 is a view showing a conductor line pattern of a 5-GHz-band resonator having a slit length of 175 degrees for describing the second embodiment and a resonance characteristic of such a resonator.
Figure 18:
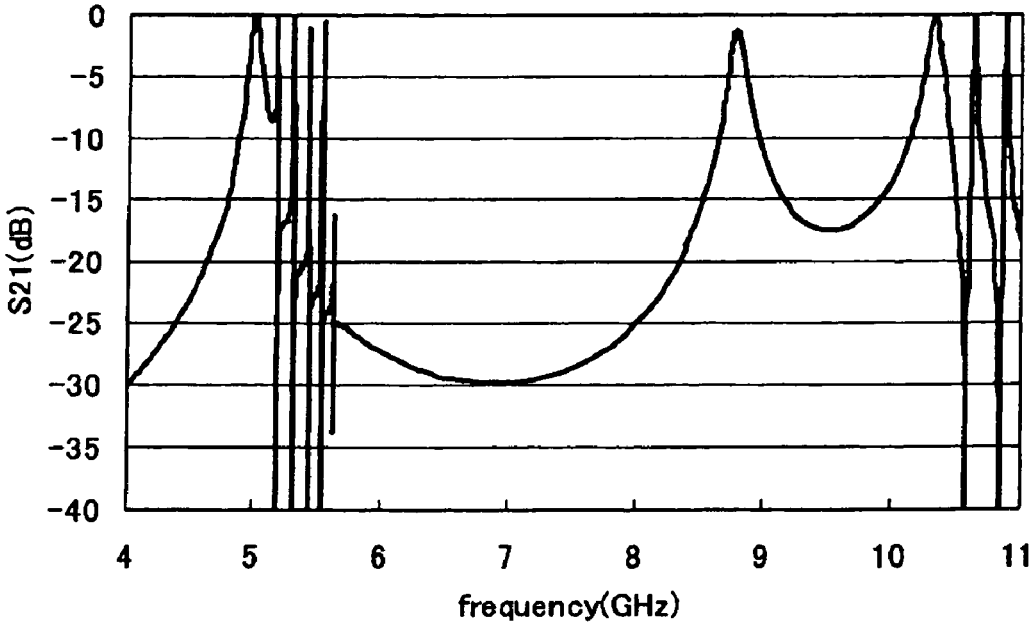
Figure 19:
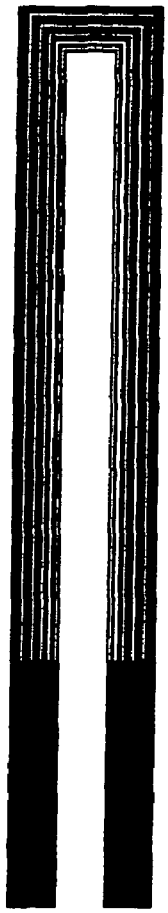
FIG. 19 is a view showing a conductor line pattern of a 5-GHz-band resonator having a slit length of 131 degrees for describing the second embodiment and a resonance characteristic of such a resonator.
Figure 19:
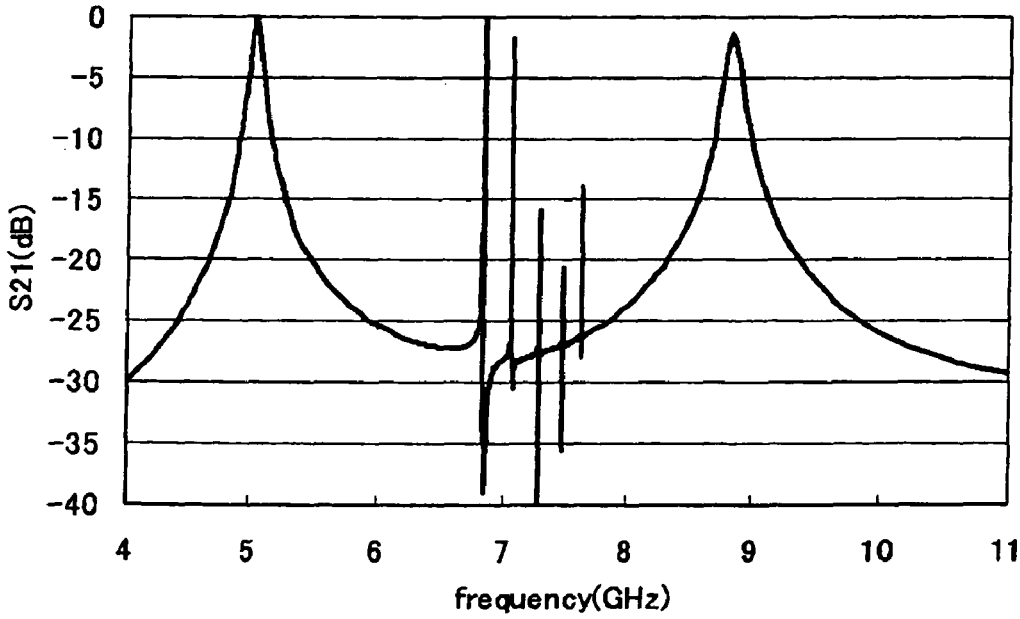
Figure 20:
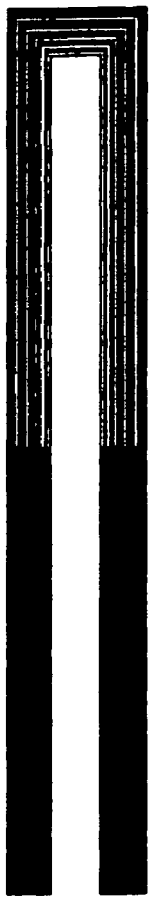
FIG. 20 is a view showing a conductor line pattern of a 5-GHz-band resonator having a slit length of 90 degrees for describing the second embodiment and a resonance characteristic of such a resonator.
Figure 20:
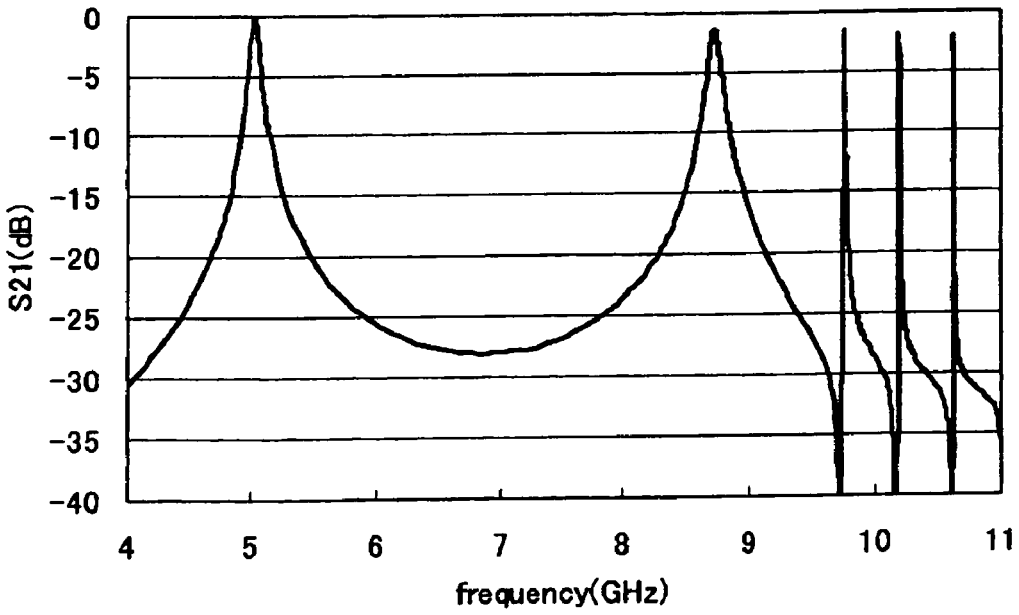
Figure 21:
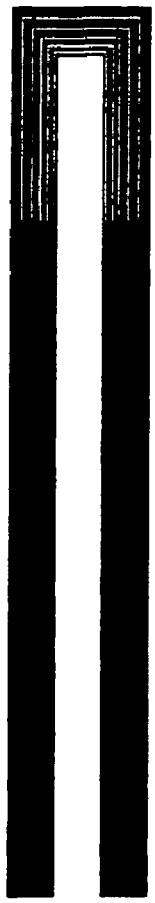
FIG. 21 is a view showing a conductor line pattern of a 5-GHz-band resonator having a slit length of 45 degrees for describing the second embodiment and a resonance characteristic of such a resonator.
Figure 21:
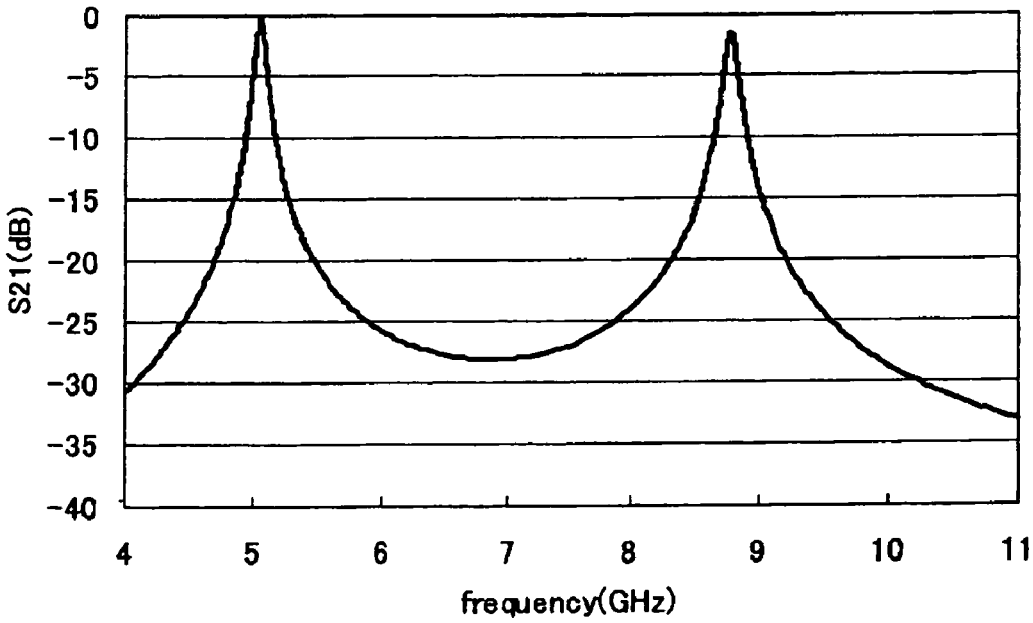
Figure 22:
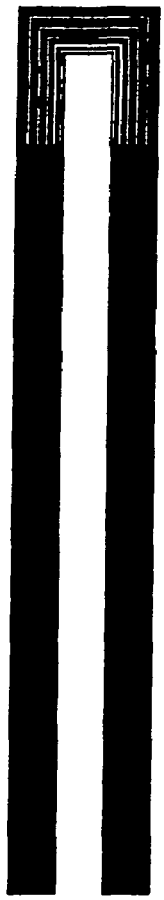
FIG. 22 is a view showing a conductor line pattern of a 5-GHz-band resonator having a slit length of 30 degrees for describing the second embodiment and a resonance characteristic of such a resonator.
Figure 22:
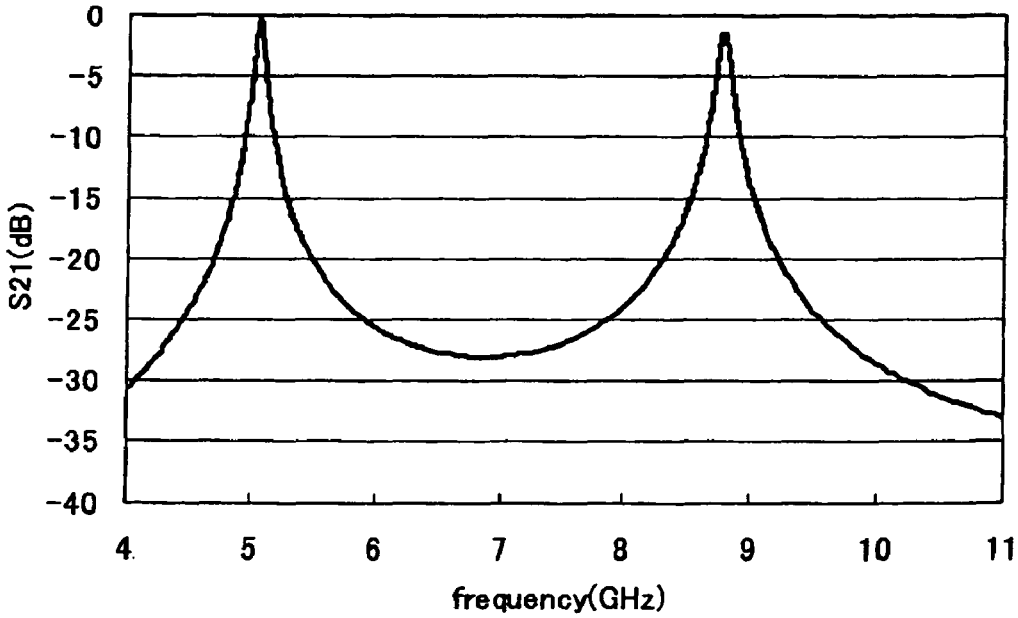

FIGS. 18 through 22 show results for the 5-GHz-band hairpin-type resonator acquired when the slit length is changed to 175 degrees, 131 degrees, 90 degrees, 45 degrees, and 30 degrees of an electrical length, respectively. When the slit length was changed to 175 degrees and 131 degrees, as shown in FIGS. 18 and 19, respectively, unwanted resonance modes are present in a range from 5 GHz to 8.8 GHz. In the meantime, when the slit length was changed to 90 degrees, 45 degrees, and 30 degrees, as shown in FIGS. 20-22, respectively, an unwanted resonance mode is present in a frequency of 8.8 GHz or higher.

Therefore, if the slit length is set to as long as 90 degrees or less in terms of an electrical length, a resonator with slits can be used, over a range from 800 MHz to 5 GHz, in the same manner as is a slitless resonator. From the results, similar results are readily conceived to be yielded by a resonator having a wider frequency range from, for instance, about 400 MHz that is one-half of 800 MHz to about 10 GHz that is twice as high as 5 GHz. Further, the shape of the resonator is not limited solely to a hairpin shape, but the present invention can also be applied to a resonator having an S shape, an M shape, or an oval shape. From the fact that unwanted resonance is generated by resonance corresponding to the length of slits, the essential requirement for such a case is readily conceived that the length of continual slits be set to 90 degrees or less.

As mentioned above, as the slit length becomes shorter, unwanted resonance can be made distant from required resonance in terms of a frequency axis, which is conceived to be effective. However, when the slit length is too short, dispersion of a concentrated current, which is the original effect of the slits, is hindered. From the viewpoint of prevention of dispersion of a concentrated current, it is desirable that the electrical length of the slit be 45 degrees or more.

Figure 23:
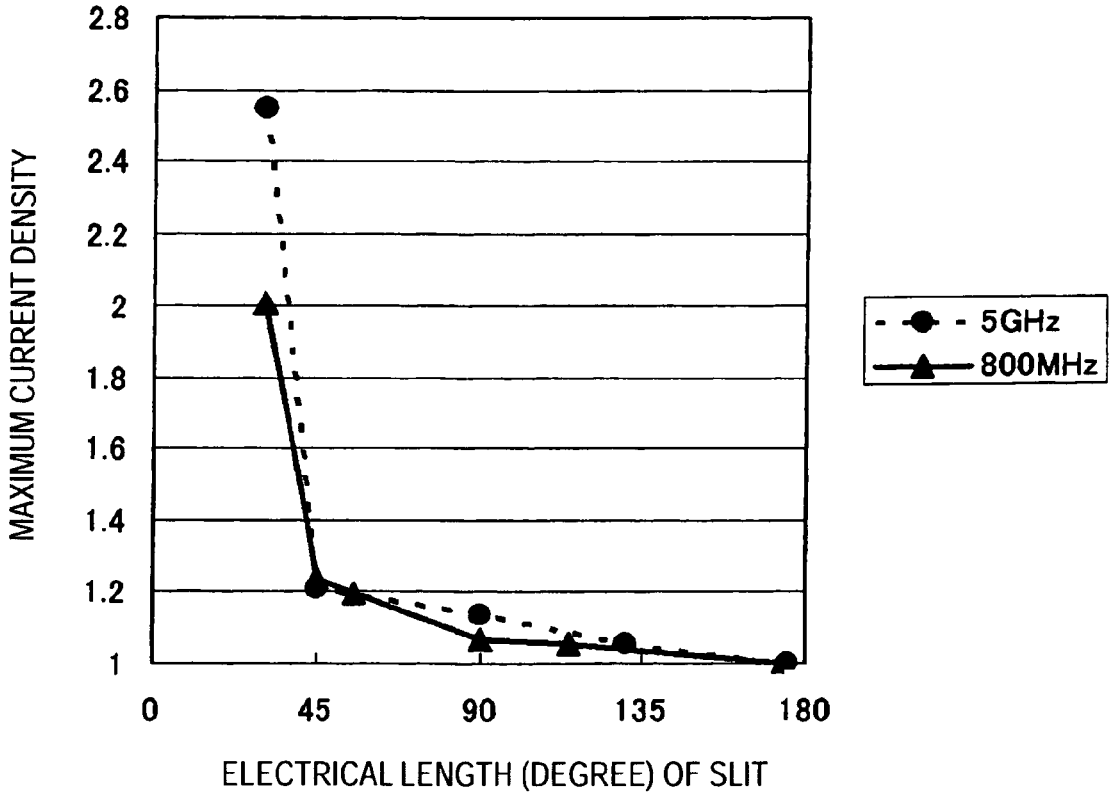
FIG. 23 is a view showing a relationship between a slit length and the maximum current density of the resonator according to the second embodiment.

FIG. 23 shows a relationship between a slit length (an electrical length or a degree) and the maximum current density of the resonator shown in FIGS. 11 through 16 and that of the resonator shown in FIGS. 18 through 22. The maximum current density is a quantity standardized on the assumption that the maximum current density achieved at the longest slit length is taken as one. In a graph shown in FIG. 23, a solid line designates a result yielded by the 800-MHz-band resonator, and a dotted line designates a result yielded by the 5-GHz-band resonator. From the drawing, it is understood that, as the electrical length of the slit comes to a value of less than 45 degrees, the maximum current density abruptly increases, to thus lead to a reduction in the effect of the slits.

Figure 24A:
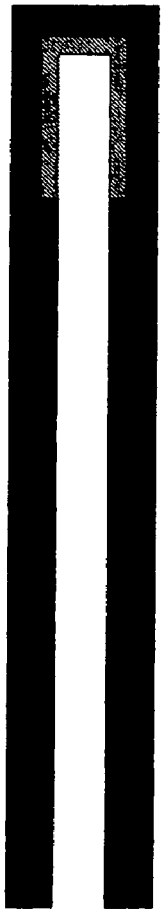
FIGS. 24A to 24C are descriptive views of the relationship between a slit length and the maximum current density of the resonator according to the second embodiment.
Figure 24B:
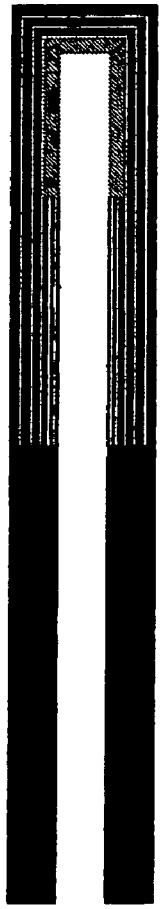
Figure 24C:
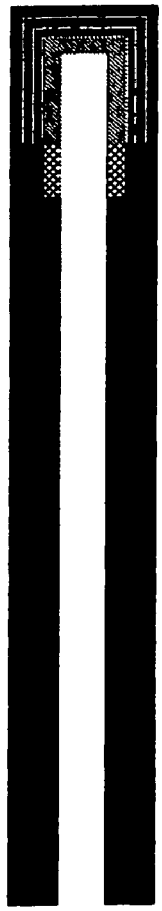

FIGS. 24A to 24C are descriptive views showing a relationship between a slit length and the maximum current density of a resonator. A high-current-density area in a U-shaped half-wave hairpin slitless resonator corresponds to the neighborhood of a shaded area provided on a resonator pattern shown in FIG. 24A. In a case where slits are formed in the half-wave hairpin resonator, so long as the slits are longer than the shaded area, a current concentration on the shaded area can be dispersed by forming the slits, and the maximum current density can be reduced as shown in FIG. 24B. Conversely, as shown in FIG. 24C, when the slits are shorter than the shaded area, a portion of the shaded area (a grid area in the drawing) juts out from the slits, whereupon the current concentration on this area cannot be lessened. Therefore, when the slit length is set to a certain length or less, the maximum current density abruptly increases.

Further, in the case of the half-wave hairpin resonator, a threshold value of the slit length is conceived to be less than 45 degrees in terms of an electrical length. Since the 800-MHz-band resonator shows essentially the same tendency as that exhibited by the 5-GHz-band resonator. Hence, the same results are expected to be yielded by a resonator having a wider frequency range, for instance, from about 400 MHz (one-half 800 MHz) to about 10 GHz (twice 5 GHz).

When the resonator does not assume a hairpin shape but assumes a shape involving a large number of bent portions, such as an S shape, an M shape, and an oval shape, a location where a current is concentrated is dispersed, so that the threshold value of the slit length is conceived to become smaller than 45 degrees. Therefore, as long as the slit length is at least 45 degrees or longer, the effect for dispersing a current concentration is yielded.

Figure 25:
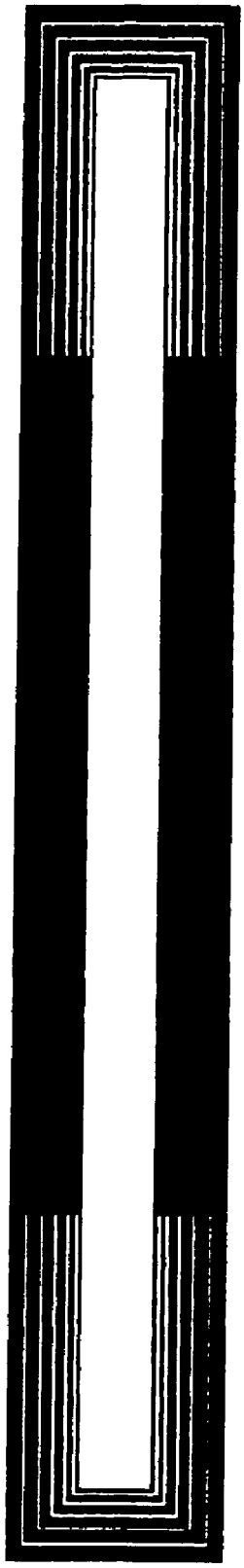
FIG. 25 is a plan view showing a conductor line pattern of a resonator of the modification according to the second embodiment.
Figure 26:
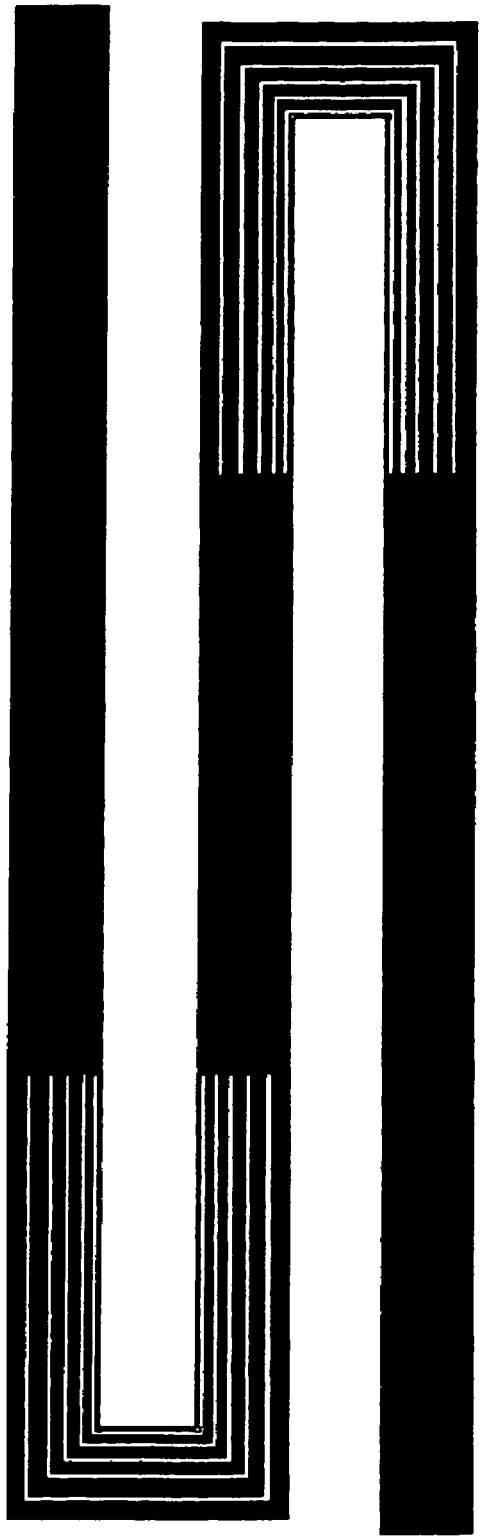
FIG. 26 is a plan view showing a conductor line pattern of a resonator of the modification according to the second embodiment.
Figure 27:
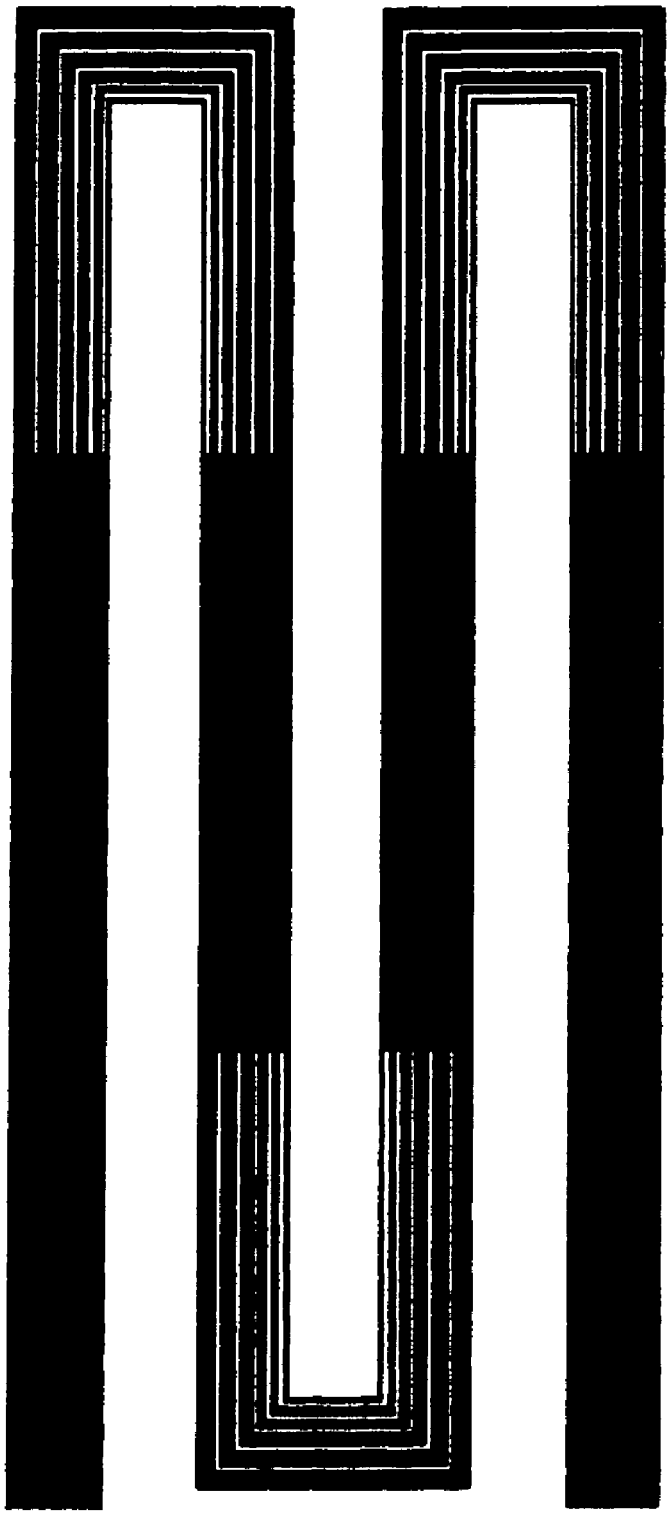
FIG. 27 is a plan view showing a conductor line pattern of a resonator of the modification according to the second embodiment.

As mentioned above, the present embodiment can also be applied to a resonator other than the U-shaped hairpin resonator mentioned above. FIGS. 25 through 27 are plan views showing conductor line patterns of resonators of different shapes that are modifications of the present embodiment. FIG. 25 is an example in which the present embodiment is applied to an oval resonator; FIG. 26 is an example in which the present embodiment is applied to an S-shaped resonator; and FIG. 27 is an example in which the present embodiment is applied to an M-shaped resonator. However, the present embodiment is not limited to these resonators. The present embodiment can also be applied to another resonator, so long as the resonator is made up of a transmission line having a conductor line pattern with bent portions.

Third Embodiment

A filter according to a third embodiment of the present invention corresponds to a filter built from, for instance, a single or a plurality of resonators described in connection with the first and second embodiments.

Figure 28:
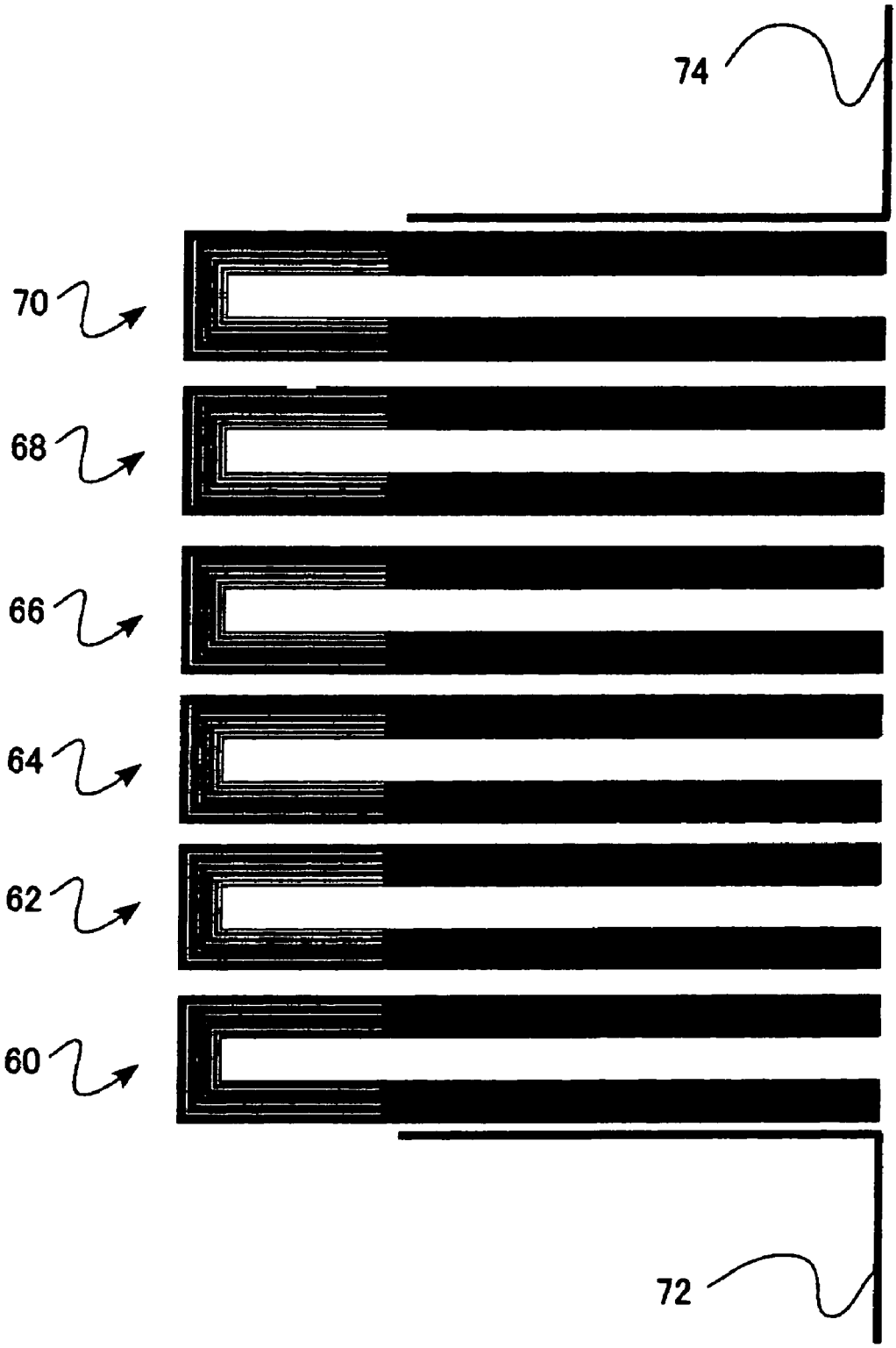
FIG. 28 is a plan view showing a conductor line pattern in a filter according to a third embodiment.

FIG. 28 is a plan view showing a conductor line pattern in the filter of the present embodiment. In the conductor line, six resonators 60, 62, 64, 66, 68, and 70 are arranged in series, to thus constitute a six-stage Chebyshev filter, wherein the resonators have the same shape as that of the resonator shown in FIG. 8. At both ends of the resonators, L-shaped conductor lines are arranged and are extended toward ends of a substrate, to thus constitute input and output feeders 72 and 74.

As mentioned above, the filter is built by use of low-loss, high-power-handling resonators, whereby a low-loss, high-power-handling filter can be implemented. Although the six-stage Chebyshev filter is described as an example, the present invention is not limited thereto. So long as a resonator is included, the present invention can be applied to various types of filters, such as a bandpass filter, a band-reject filter, a high-pass filter, a low-pass filter, and the like.

The embodiments of the present invention have been described thus far by reference to specific examples. Explanations about the present embodiments are given for the resonator, the filter, and the like, and descriptions about elements that are not directly required for explanation of the present invention are omitted. Elements associated with required resonators, filters, and the like, can be selected and used, as required.

In addition, all resonators and filters that include the elements of the present invention and that can be designed and altered, as necessary, by the skilled in the art fall within the scope of the present invention. The scope of the present invention is defined by the scope of claims and their equivalents.

According to an aspect of the present invention, there are provided a resonator and a filter in which a current distribution at the bent portion of the conductor line is uniformed to have a low loss property and a high-power handling.

What is claimed is:

1. A resonator comprising:

a transmission line comprising a conductor line with a bent portion, wherein the conductor line has a plurality of slits disposed therein, the plurality of slits being disposed in an extending direction of the conductor line to pass through the bent portion, and wherein the plurality of slits are disposed to have progressively narrower intervals from an outer-side of the bent portion to an inner-side of the bent portion.

2. The resonator of claim 1, wherein the plurality of slits are not provided in both ends of the conductor line.

3. The resonator of claim 1, wherein the plurality of slits have an electrical length of 45 degrees to 90 degrees at a resonance frequency of the resonator, and wherein the plurality of slits are disposed so that a lengthwise center of the plurality of slits is positioned at substantially the same position as a lengthwise center of the bent portion.

4. The resonator of claim 1, wherein the conductor line has an angular-U shape.

5. The resonator of claim 1, wherein the conductor line has a circular-U shape.

6. The resonator of claim 1, wherein the conductor line comprises a superconducting material.

7. The resonator of claim 1, wherein the transmission line comprises one of:

a strip line; or a microstrip line.

8. A filter comprising the resonator of claim 1.

* * * * *